US006017643A

United States Patent [19]

Kobayashi et al.

[11] Patent Number: 6,017,643

[45] Date of Patent: Jan. 25, 2000

[54] HOT-DIP ALUMINIZED STEEL SHEET, METHOD OF MANUFACTURING THE SAME AND ALLOY-LAYER CONTROL APPARATUS

[75] Inventors: Masayuki Kobayashi; Takashi Saori; Masaki Okano, all of Sakai, Japan

[73] Assignee: Nisshin Steel Co., Ltd., Tokyo, Japan

[21] Appl. No.: 08/727,544

[22] PCT Filed: Feb. 9, 1996

[86] PCT No.: PCT/JP96/00307

§ 371 Date: Oct. 23, 1996

§ 102(e) Date: Oct. 23, 1996

[87] PCT Pub. No.: WO96/26301

PCT Pub. Date: Aug. 29, 1996

[30] Foreign Application Priority Data

Feb. 24, 1995 [JP] Japan ..... 7-036498

[51] Int. Cl.[7] ..... B32B 15/10; B05D 3/14; B05C 11/00

[52] U.S. Cl. ..... 428/653; 428/654; 428/684; 427/8; 427/9; 427/431; 427/436; 118/674; 118/712; 118/407; 118/419; 374/124; 374/137

[58] Field of Search ..... 428/653, 654, 428/684, 939; 427/9, 431, 436, 8; 148/242, 279, 508, 510, 511; 118/674, 712, 407, 419; 374/137, 124

[56] References Cited

U.S. PATENT DOCUMENTS

| | | | |
|---|---|---|---|
| 3,632,453 | 1/1972 | Patterson | 148/6.15 R |
| 3,664,293 | 5/1972 | Hozumi et al. | 118/5 |
| 4,751,957 | 6/1988 | Vaught | 164/463 |
| 4,891,274 | 1/1990 | Higuchi et al. | 428/653 |
| 5,518,772 | 5/1996 | Andachi et al. | 427/349 |
| 5,529,816 | 6/1996 | Sartini et al. | 427/600 |

FOREIGN PATENT DOCUMENTS

| | | |
|---|---|---|
| 51-46739 | 12/1976 | Japan . |
| 52-060239 | 5/1977 | Japan . |
| 1-104752 | 4/1989 | Japan . |
| 4-176854 | 6/1992 | Japan . |
| 5-287488 | 11/1993 | Japan . |

*Primary Examiner*—Paul Thibodeau
*Assistant Examiner*—Holly C Rickman
*Attorney, Agent, or Firm*—Wenderoth, Lind & Ponack, L.L.P.

[57] ABSTRACT

In order to provide a hot-dip aluminized steel sheet with increased peeling resistance of the coating layer, the thickness of the Fe—Al—Si alloy-layer is set to be 1–5 μm, while the maximum differential unevenness of thickness of the Fe—Al—Si alloy layer is set to be 0.5–5 μm. The hot-dip aluminized steel sheet is manufactured by controlling an elapsed time from the beginning of immersion of the base-metal steel sheet into the aluminizing bath to the completion of solidification of the coating-metal layer which has passed through the bath. In addition another elapsed time is controlled from the time after the base-metal steel sheet has been guided out over the bath to the completion of solidification of the coating-metal layer.

8 Claims, 13 Drawing Sheets

| POSITION | FE% | Si % |
|---|---|---|
| A2 | 28.0 | 16.8 |
| B2 | 29.3 | 16.8 |
| C2 | 28.5 | 17.2 |
| D2 | 30.8 | 15.3 |
| E2 | 34.8 | 11.7 |
| F2 | 99.7 | 0.3 |

| POSITION | FE% | Si % |
|---|---|---|
| A3 | 33.5 | 12.5 |
| B3 | 34.7 | 11.9 |
| C3 | 40.5 | 9.9 |
| D3 | 99.7 | 0.6 |

HOT-DIP ALUMINIZED STEEL SHEET, METHOD OF MANUFACTURING THE SAME AND ALLOY-LAYER CONTROL APPARATUS

FIELD OF THE INVENTION

The present invention relates to a hot-dip aluminized steel sheet with high resistance to heat and corrosion which is useful as a member of auto exhaust systems and heat appliances. The present invention also relates to a method of manufacturing the aluminized steel sheet and an alloy-layer control apparatus which is used in the method. More particularly, the present invention relates to the control of the thickness and section pattern of an Fe—Al—Si alloy layer which is inevitably produced at the interface between a coating-metal layer and a base-metal steel sheet within an aluminized layer.

DESCRIPTION OF THE BACKGROUND ART

When a hot-dip aluminized steel sheet is manufactured with a continuous hot-dip aluminizing plant (line), as illustrated in FIG. 17, a base-metal steel sheet 4 is guided into a hot-dip Al—Si plating (aluminizing) bath 1 which has been adjusted to a specific bath composition and bath temperature and guided out of the bath 1 after having rounded a sink roll 2 in the bath 1. Next, the amount of the coating (the thickness of the coating layer) is adjusted by a gas-wiping unit 3 placed immediately above the bath 1. Here, the plant is generally provided with a cooling unit 5 above the bath 1 which forcedly cools the coating-metal layer (with jets of a gas, gas/liquid, etc.) so as to completely solidify the coating-metal layer before the coated steel sheet 6 reaches an upward top roll 9.

With hot-dip aluminized steel sheets manufactured in this way, diffusion of Fe atoms across the interface between the base metal steel sheet and the coating-metal layer (infiltration of Fe atoms in the base metal steel sheet into the coating-metal layer through diffusion) results in the inevitable formation of an Fe—Al—Si alloy layer at the interface. The alloy layer, being hard and fragile, promotes peeling of the coating layer from the coated steel sheet during press working. Particularly in cases where the steel sheet is subjected to strong working such as drawing or squeezing, the alloy-layer thickness must be controlled to approximately 5 $\mu$m or smaller in order to ensure the press workability (e.g., Japanese Examined Patent Application Publication SHO 51-46739).

A variety of proposals have been suggested for coating conditions to control the production and the growth of the alloy-layer including:

(a) Adjustment of the coating bath so as to have a specific Al—Si bath composition (Si content: 3–13%), and limiting the bath-immersion temperature of the base metal steel sheet (the sheet temperature immediately before its immersion into the bath) to a range between the melting point of the metal in the aluminizing bath and the melting point plus 40° C. (Japanese Unexamined Patent Application Disclosure HEI 4-176854);

(b) Quenching of the coated steel sheet guided out of the coating bath by spraying a coolant (a liquid, gas plus liquid, etc.) from a cooling unit placed above the bath (Japanese Unexamined Patent Application Disclosure SHO 5260239);

(c) Precoating of the base metal steel sheet surface with a layer of a metal having a lower melting point than the coating (i.e. plating) metal to maintain the steel sheet temperature at 500° C. or lower until the coating is accomplished (Japanese Unexamined Patent Application Disclosure HEI 1-104752);

(d) Setting the bath-immersion temperature of the base-metal steel sheet to a temperature 50–100° C. lower than the coating bath temperature (Japanese Unexamined Patent Application Disclosure HEI 5-287488); etc.

However, it has proven difficult to satisfactorily control the alloy-layer thickness only through control of the operation conditions as suggested by the prior art, in other words through the adjustment of the coating bath composition and temperature, the control of the bath-immersion temperature of the base metal steel sheet and the high-level forced-cooling of the coated metal layer, etc. While precoating the surface of the base-metal steel sheet with a special metal layer results in an increased number of steps and an increased cost. In addition, all the processes of the prior art fail to precisely control the alloy-layer thickness, since no quantitative relationship is elucidated to exist between the production and the growth rate of the alloy layer, and the operational conditions.

After repeated thorough investigation of the phenomenon of alloy-layer production, the present inventors have found that the thickness of the alloy layer produced has a quantitative correlation with the time elapsed from the beginning of the immersion of the base-metal steel sheet into the coating bath to the completion of the solidification of the coating-metal layer on the surface of the steel sheet which has passed through the bath. Furthermore, the present inventors have discovered that adjustment of the lapsed time allows precise control of the alloy-layer thickness to a desired layer thickness (or a smaller thickness).

It has also been found that alloy layers have remarkably different section patterns depending on the operational conditions coating, that alloy layers with lower degrees of surface unevenness and thus higher degrees of flatness have higher resistance to peeling of the coating layer, that the section pattern changes depending on the time elapsed from the time at which the coated steel sheet is guided above the coating bath to the completion of solidification of the coating-metal layer, and that adjustment of the elapsed time allows control to a more desired section pattern.

The present invention, which has been accomplished based on the findings mentioned above, provides a hot-dip aluminized steel sheet with high resistance to peeling of the aluminized layer, a method of manufacturing a continuous hot-dip aluminized steel sheet which allows precise control of the thickness and the section pattern of the alloy layer produced, and an alloy-layer control apparatus which is used in the method.

SUMMARY OF THE INVENTION

The present invention relates to a hot-dip aluminized steel sheet which comprises an Al—Si coating-metal layer having a Si content of 3–13% by weight which is applied to the surface of a base-metal steel sheet, and an Fe—Al—Si alloy layer at the interface between the base-metal steel sheet and the coating-metal layer. The invention is characterized in that the Fe—Al—Si alloy layer has a thickness of 1–5 $\mu$m, and a maximum differential unevenness of thickness of the Fe—Al—Si alloy layer of 0.5–5 $\mu$m.

The Fe—Al—Si alloy layer of the hot-dip aluminized steel sheet according to the present invention has a thickness and a maximum differential unevenness of thickness which both lie within the proper ranges. Since the alloy layer is very hard and brittle, a thickness or maximum differential unevenness of thickness exceeding the upper limits cause lower resistance of the coating layer (or aluminized layer) to peeling. This leads to peeling of the coating layer during press working. Further, even in cases where the thickness of the alloy layer does not exceed the upper limit, the resistance of the coating layer to peeling decreases due to the notch-like configuration when the maximum differential unevenness of thickness exceeds the upper limit. This also results in peeling of the coating layer during press working. In conclusion, both the thickness and the maximum differential unevenness of thickness of the alloy layer must be controlled in order to increase the resistance of the coating layer to peeling. The hot-dip aluminized steel sheet of the invention, which comprises an alloy layer with both a controlled thickness and a controlled maximum differential unevenness of thickness, to within the proper ranges, has a very high coating layer peeling resistance.

The invention also relates to a method of manufacturing a continuous, hot-dip aluminized steel sheet which comprises guiding a base-metal steel sheet into a hot-dip aluminizing bath of an Al—Si bath composition with a Si content of 3–13% by weight to form a coating-metal layer on the sheet surface. The invention additionally relates to forming an Fe—Al—Si alloy layer at the interface between the coating-metal layer and the base-metal steel sheet, and forcedly cooling the coating-metal layer to solidify, with the aid of a cooling unit placed above the bath.

The present method is characterized by controlling the lapse of time from the beginning of immersion of the base-metal steel sheet into the aluminizing bath to the completion of solidification of the coating-metal layer. The control being made on the basis of the correlation between the lapse of time and the thickness of the Fe—Al—Si alloy layer. Thus, the thickness of the alloy layer may be smaller than a predetermined value.

According to the invention, the lapse of time which corresponds to the solidification time of the coating layer is controlled on the basis of the correlation as the rational reference. Thus, the thickness of the alloy layer is reduced to no more than a predetermined value. This allows precise control of the thickness of the alloy layer to the predetermined reduced value.

The invention is further characterized in that the lapse of time is controlled by adjustment of either or both the conveying velocity of the base-metal steel sheet and the flow rate of the coolant in the cooling unit.

According to the invention, since the lapse of time which corresponds to the thickness of the alloy layer may be controlled by adjustment of the conveying velocity and the flow rate of the coolant which change the solidification time of the coating layer, the thickness of the alloy layer may be speedily and reliably controlled with precision.

The invention also relates to a method of manufacturing a continuous, hot-dip aluminized steel sheet which comprises guiding a base-metal steel sheet into a hot-dip aluminizing bath of an Al—Si bath composition with a Si content of 3–13% by weight to form a coating-metal layer on the sheet surface. The invention further relates to forming an Fe—Al—Si alloy layer at the interface between the coating-metal layer and the base-metal steel sheet, and forcedly cooling the coating-metal layer to solidify, with the aid of a cooling unit placed above the bath.

The present method is characterized by controlling a first elapsed time from the beginning of immersion of the base-metal steel sheet into the aluminizing bath to the completion of solidification of the coating-metal layer. The control being made on the basis of the correlation between the first elapsed time and the thickness of the Fe—Al—Si alloy layer. Thus the thickness of the alloy layer may be smaller than a predetermined value.

Also, a second elapsed time is controlled from the time after the coated steel sheet has been guided out over the aluminizing bath to the completion of solidification of the coating-metal layer. The control being made on the basis of the correlation between the second elapsed time and the value reflecting the section pattern of the alloy layer. Thus, the value reflecting the section pattern of the alloy layer matches a predetermined value.

According to the invention, since the first and the second elapsed times are controlled on the basis of the respective correlations as the rational references, the thickness of the alloy layer and the value reflecting the section pattern of the alloy layer may be precisely controlled to the predetermined values. This also allows effective control of the production of the alloy layer, and provides the section pattern of the alloy layer with a high degree of flatness.

The invention is further characterized in that the first elapsed time and the second elapsed time are controlled by adjustment of either or both the conveying velocity of the base-metal steel sheet and the flow rate of the coolant in the cooling unit.

According to the invention, since the first and the second elapsed times which correspond to the thickness and the section pattern of the coating layer may be controlled by adjustment of the conveying velocity and the flow rate of the coolant which change the solidification time of the coating layer, the thickness of the alloy layer and the section pattern of the alloy layer may be speedily and reliably controlled with precision.

The invention also relates to an alloy-layer control apparatus for a continuous, hot-dip aluminized steel sheet which guides a base-metal steel sheet into a hot-dip aluminizing bath of an Al—Si bath composition with a Si content of 3–13% by weight to form a coating-metal layer on the sheet surface. The invention further relates to forming an Fe—Al—Si alloy layer at the interface between the coating-metal layer and the base metal steel sheet, and forcedly cools the coating-metal layer to solidify with the aid of a cooling unit placed above the bath.

The apparatus being characterized by comprising a solidification location detecting means, a velocity detecting means, a flow rate detecting means, a flow control means, a velocity control means, a setting means, operating means, and a control means.

The solidification location-detecting means detects the location at which the solidification of the coating metal layer has been completed.

The velocity-detecting means detects the conveying velocity of the base-metal steel sheet.

The flow rate-detecting means detects the flow rate of the coolant in the cooling unit.

The flow rate control means controls the flow rate of the coolant in the cooling unit.

The velocity control means controls the conveying velocity of the base-metal steel sheet.

The setting means sets the desired thickness of the Fe—Al—Si alloy layer, the desired value reflecting the desired value reflecting the section pattern of the alloy layer, the conveying length of the coated steel sheet through the coating bath, and the conveying length of the coated steel sheet from the surface of the aluminizing bath to the outlet of the cooling unit.

The operating means calculates a first elapsed time from immersion of the base-metal steel sheet into the aluminizing bath to the completion of solidification of the coating-metal layer which has passed through the bath, and a second elapsed time from the time for the coated steel sheet to have been guided out of the bath to the completion of solidification of the coating-metal layer, on the basis of values detected by the solidification location-detecting means and the velocity detecting means and the respective conveying lengths set by the setting means.

The control means calculates in response to output from the operating means, the thickness of the alloy layer which corresponds to the calculated value of the first elapsed time on the basis of the correlation between the first elapsed time and the thickness of the alloy layer.

The control means also calculates the value which reflects the section pattern of the alloy layer which in turn corresponds to the calculated value of the second elapsed time on the basis of the correlation between the second elapsed time and the value reflecting the section pattern of the alloy layer, and controls either or both the flow rate control means and the velocity control means so that the calculated thickness of the alloy layer and the calculated value reflecting the section pattern of the alloy layer match the respective desired values set by the setting means.

According to the invention, the alloy-layer control apparatus detects the location at which the solidification of the coating-metal layer has been completed. This location is used to calculate the first elapsed time and the second elapsed time which are values corresponding to the solidification time. The location is also used to calculate the thickness of the alloy layer which corresponds to the first elapsed time and the value reflecting the section pattern of the alloy layer which corresponds to the second elapsed time, on the basis of their correlation. Finally, the location is used to control either or both the flow rate of the coolant and the conveying velocity which cause change in the solidification time, so that the respective calculated values match the desired values. Therefore, the alloy-layer control apparatus allows precise control of the thickness of the alloy layer and the value reflecting the section pattern of the alloy layer so as to match the desired values.

The solidification location-detecting means of the invention is characterized by comprising a temperature distribution-detecting means, an imaging means, and an image display means.

The temperature distribution-detecting means detects the two-dimensional temperature distribution of the coated steel sheet.

The imaging means images the two-dimensional temperature distribution in response to output from the temperature distribution-detecting means.

The image display means displays the image of the two-dimensional temperature distribution in response to output from the imaging means and detecting the location at which the solidification of the coating-metal layer has been completed, by referring to the displayed image.

According to the invention, the solidification location-detecting means detects the two-dimensional temperature distribution of the coated steel sheet and displays it as an image. The solidification location-detecting means also determines the location at which the coating-metal layer has fully solidified with reference to the displayed image to thus detect the complete solidification location based on the former position. Since the solidification location-detecting means detects the temperature distribution of the coated steel sheet in a two-dimensional manner, the full solidification-location is reliably determined even when it moves along the sheet width or in the direction of its conveyance. This results in accurate detection of the complete solidification location of the coating-metal layer.

DETAILED DESCRIPTION OF THE INVENTION

The hot-dip aluminized steel sheet (or the "coated steel sheet") has an Al—Si coating-metal layer (or the "coating layer") on the surface of the base-metal steel sheet, with an Fe—Al—Si alloy layer (or the "alloy layer") formed at the interface between the base-metal steel sheet and the coating layer.

Figure 1:
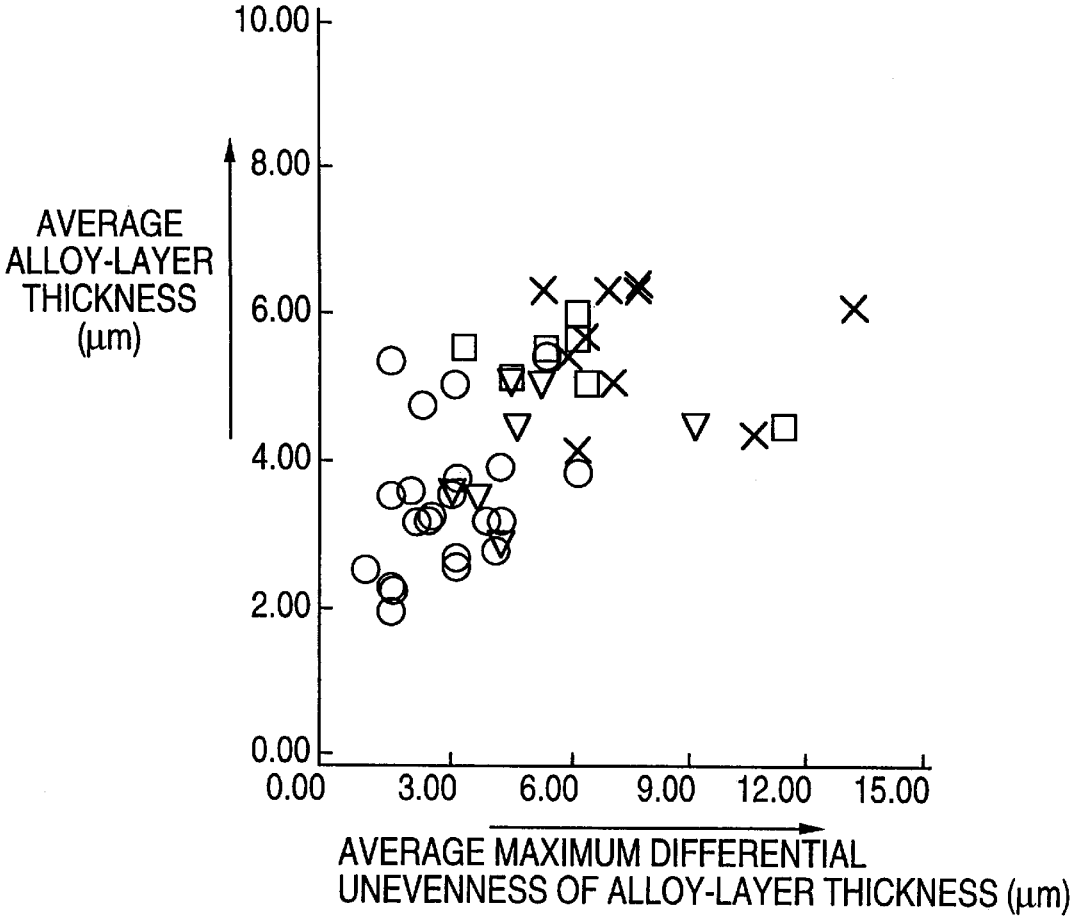
FIG. 1 is a graph showing the relationship between the average thickness of the alloy layer of the hot-dip aluminized steel sheet and the average maximum differential unevenness of thickness of the alloy layer, and evaluation of resistance of the coating-metal layer during drawing work.
Figure 2:
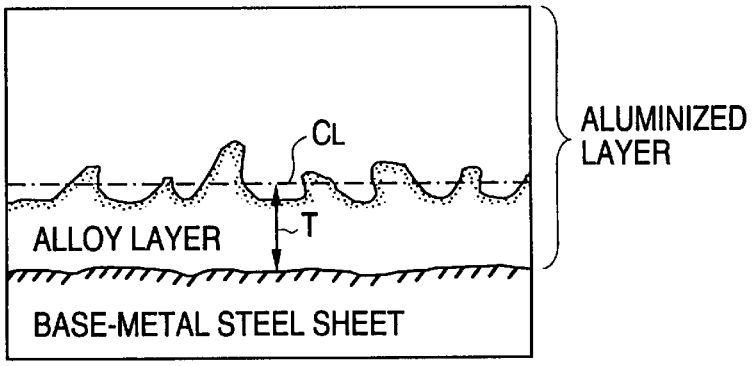
FIG. 2 is a view illustrative of a method of calculating the thickness of the alloy layer.

FIG. 1 is a graph showing the relationship between the average thickness of the alloy layer of the hot-dip aluminized steel sheet and the average maximum differential unevenness of thickness of the alloy layer, and evaluation of resistance of the coating-metal layer during drawing work. In FIG. 1, the amount of deposition of the coating of the hot-dip aluminized steel sheet is 50–160 g/m$^2$ as the total of the amounts of deposition on both the front and the back sides. The thickness T of the alloy layer is defined as the distance of the imaginary center line CL representing the average thickness from the base-metal steel sheet in the direction of the sheet thickness, as illustrated in FIG. 2. Plotted along the y-axis in FIG. 1 are average thicknesses of the alloy layers which are calculated by observing the alloy layers in three fields of vision with a scanning electron microscope having a magnification of 2,000 times and measuring the thicknesses Ts of the alloy layers as defined above in the respective fields of vision to determine the average thickness T. The maximum differential unevenness of thickness of each alloy layer is determined by measuring the gap G in distance along the direction of the sheet thickness between the portion of the alloy layer with the greatest level of growth and the portion with the most retarded level of growth. Stated in other words, the maximum differential unevenness of thickness is a distance, measured perpendicularly from the surface of the base-metal steel sheet, between a position on the interface between the Fe—Al—Si alloy layer and the Al—Si coating metal sheet nearest the base-metal steel sheet and a point on the interface farthest from the sheet. Plotted along the x-axis in FIG. 1 are the average maximum differential unevenness of thickness G of the alloy layers which are calculated by observing the alloy layers in three fields of vision with a scanning electron microscope having a magnification of 2,000 times and measuring the maximum differential unevenness of thickness G of the alloy layers in the respective fields of vision to determine the average respective maximum differential unevenness of thickness G of the alloy layers. Here, FIGS. 3(1) through (4) illustrate how the maximum differential unevenness of thickness G of the alloy layers are determined for four types of section patterns of the alloy layers, respectively. Marks, for example ○, indicated in FIG. 1 are marks representing evaluation of the resistance of the coated layers to peeling which is specified in Table 1.

TABLE 1

| Marks | Evaluation of resistance to peeling |
|---|---|
| ○ | No peeling of the coating layer |
| Δ | Minute peeling of the coating layer |
| □ | Slight peeling of the coating layer |
| X | Severe peeling of the coating layer |

It is apparent from FIG. 1 that the smaller the average thickness of the alloy layer and the smaller the average maximum differential unevenness of thickness of the alloy layer, the higher the resistance to peeling of the coating layer. It is also apparent from FIG. 1 that when the average maximum differential unevenness of thickness of the alloy layer is great, the coating layer peels even if the average thickness of the alloy layer is no more than 5 μm. Finally, FIG. 1 also indicates and that when the average maximum differential unevenness of thickness of the alloy layer is very minute, the plating layer does not peel even if the average thickness of the alloy layer exceeds 5 μm.

The reason that the resistance of the plating layer to peeling is greatly influenced by both the average thickness of the alloy layer and the average maximum differential unevenness of thickness is because the alloy layer is very hard (Vickers harness: 600–800) and brittle, and because the differential unevenness of thickness results in the formation of a notch which causes a concentration of stress during working, etc. Therefore, it is advisable to reduce both the average thickness and the average maximum differential unevenness of thickness of the alloy layer in order to increase the peeling resistance of the plating layer of the hot-dip aluminized steel sheet. As far as their allowable ranges are concerned, preferably the average thickness of the alloy layer ranges from 1 to 5 μm, and the average maximum differential unevenness of thickness of the alloy layer ranges from 0.5 to 5 μm.

As the peeling resistance of the coating layer is poor when the values are high, upper limits must be set. On the other hand, lower limits must be set considering the fact that immersion into the hot-dip Al—Si bath inevitably increases the thickness of the alloy layer, and this makes it extremely difficult to reduce the average thickness of the alloy layer and the average maximum differential unevenness of thickness of the alloy layer to less than the lower limits from the point of manufacture. Further, the particularly preferred allowable ranges are the ones in which no peeling of the coating layer occurs. FIG. 1 indicates that those values are 1–3 μm for the average thickness of the alloy layer (hereafter "alloy-layer thickness") and 0.5–3 μm for the average maximum differential unevenness of thickness of the alloy layer (hereafter "maximum differential unevenness of thickness of the alloy layer").

As described above, since the aluminum-coated steel sheet according to the present embodiment has both the alloy-layer thickness and the maximum differential unevenness of thickness of the alloy layer controlled, the peeling resistance of the coating layer is very high compared to aluminum-coated steel sheets of the prior art which are controlled only in the alloy-layer thicknesses. This serves to reliably prevent peeling of the coating layer even when it is subjected to strong press working such as drawing or ironing.

Figure 4:
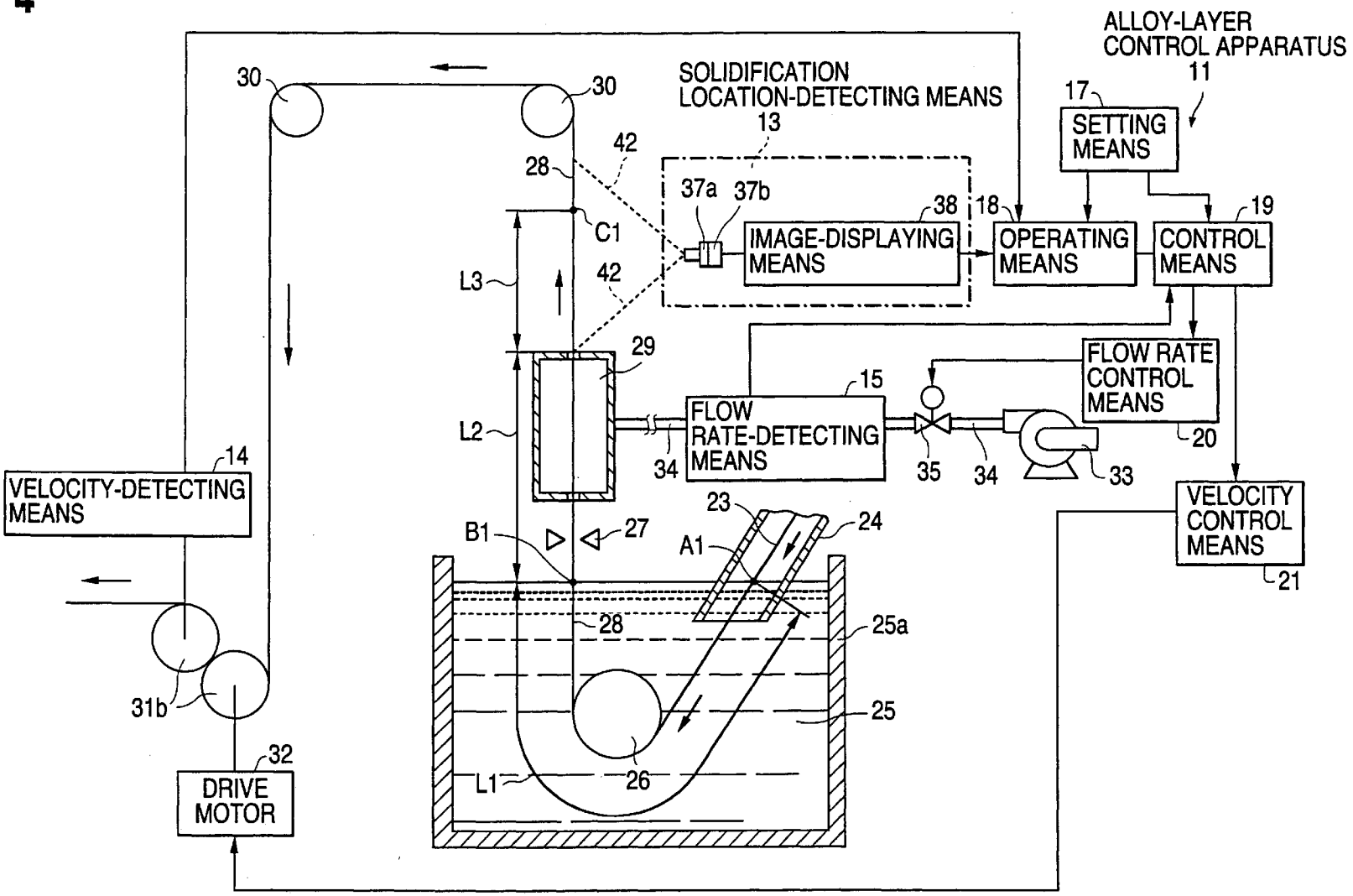
FIG. 4 is a simplified schematic diagram illustrative of the configuration of an alloy-layer control apparatus for a continuous, hot-dip aluminized steel sheet according to an embodiment of the invention.
Figure 5:
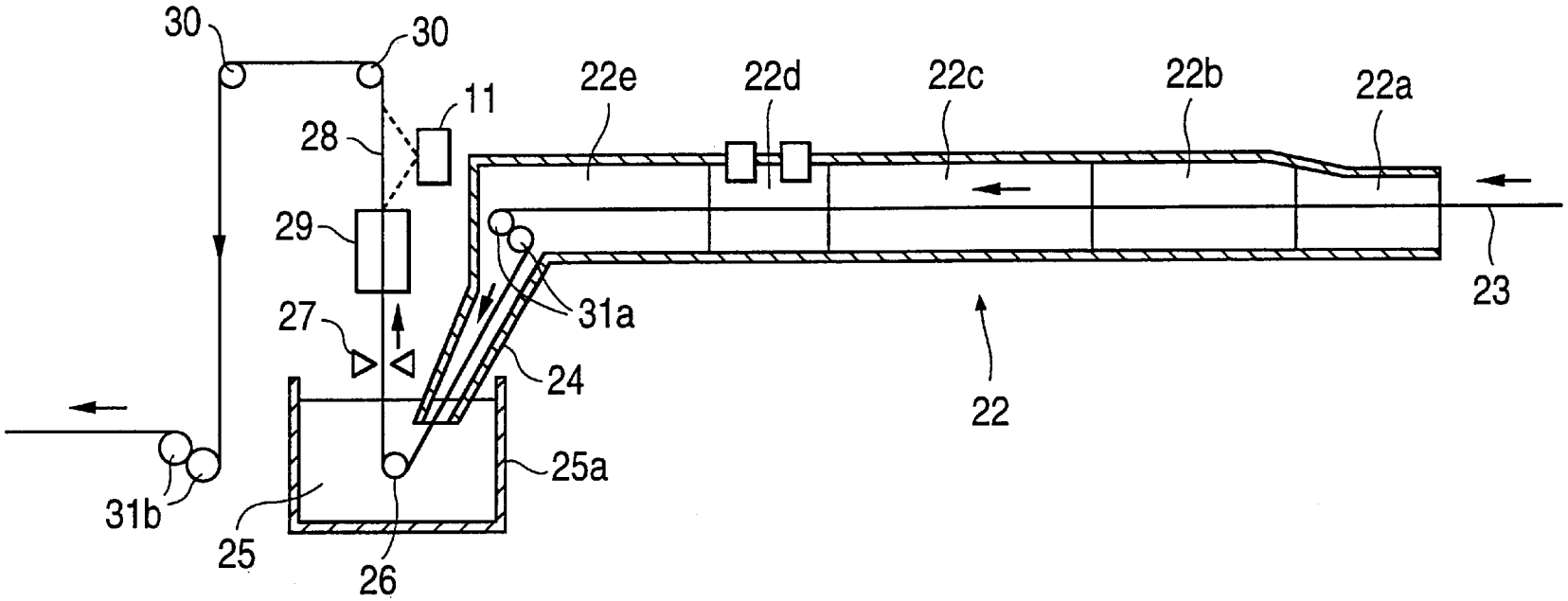
FIG. 5 is a simplified schematic diagram illustrative of main sections of the hot-dip aluminizing line.

FIG. 4 is a simplified schematic diagram illustrative of the configuration of an alloy-layer control apparatus for a continuous, hot-dip aluminized steel sheet (hereafter "alloy-layer control apparatus") according to an embodiment of the invention. FIG. 5 is a simplified schematic diagram illustrative of the main sections of the hot-dip aluminizing line. The alloy-layer control apparatus 11 is constructed of solidification location detecting means 13, velocity detecting means 14, flow rate detecting means 15, flow rate control means 20, velocity control means 21, setting means 17, operating means 18 and control means 19. The apparatus controls the alloy-layer thickness T and the section pattern of the hot-dip aluminized steel sheet 28.

After having been subjected to annealing and reduction cleaning in a reductive annealing furnace 22 of the hot-dip aluminizing line, a base-metal steel sheet 23 is conveyed, via a hot bridle roll 31*a* and a snout 24, and guided into a via hot-dip Al—Si—aluminizing bath 25 at position A1. The reductive annealing furnace 22 is provided with a preheating zone 22*a,* a non-oxidative furnace 22*b,* a heating zone 22*c,* a cooling zone 22*d* and an adjustable cooling zone 22*e* placed in that order from the upstream end. The space inside the furnace, which is located downstream from the non-oxidative furnace 22*b,* is supplied with a reducing atmosphere gas, for example, AX gas (H : 75%, N: 25%). The composition of the hot-dip Al—Si-aluminizing bath 25 is adjusted to have a Si content of 3–13% by weight, and the bath temperature is maintained between its melting point and 70° C. above its melting point. The aluminizing bath 25 is pooled in a coated pot 25*a* made of cast iron. The base-metal steel sheet 23 guided into the aluminizing bath 25 is conveyed vertically upward via a sink roll 26 in the bath 25, and guided out of the bath 25 at position B1.

The hot-dip aluminized steel sheet 28, which has been coated in the aluminizing bath 25, undergoes adjustment of the amount of deposition of the coating through a gas-wiping unit 27 placed immediately above the aluminizing bath 25. Next, the sheet is forcedly cooled by jets of a coolant, for example, air, in a cooling unit 29 placed above the gas-wiping unit 27. The coating layer of the cooled, coated steel sheet 28 solidifies at location C1 above the cooling unit 29, and is cooled by the time of its arrival at top rolls 30 placed above location C1 to such a temperature that it does not agglutinate to the top rolls 30. Here, the coolant used for cooling the coated steel sheet 28 may be a liquid (water), a mixed fluid of a liquid and a gas (water and air) or the like.

The coated steel sheet 28 which has passed around the top rolls 30 is conveyed vertically downward, and then further downstream via the bridle rolls 31*b*. The bridle rolls 31*b* are provided with a drive motor 32 which is capable of adjusting the conveying velocity of the coated steel sheet 28. In addition, the tensile force of the coated steel sheet 28 is adjusted with the hot bridle rolls 31*a* and the bridle rolls 31*b*. Here, the coated steel sheet 28 and the base-metal steel sheet 23 guided into the aluminizing bath 25 have the same conveying velocity. A centrifugal fan 33 is connected to the cooling unit 29 via an air duct 34. The centrifugal fan 33 supplies cooling air to the cooling unit 29. The amount of the cooling air supplied, more specifically, the amount of the cooling air supplied to the cooling unit 29, is adjusted with a flow rate control valve 35 provided on the air duct 34. Here, the conveying length L1 (between immersion location A1 and exit position B1) which the coated steel sheet 28 has traveled via the sink roll 26 in the aluminizing bath 25 and the conveying length L2 of the coated steel sheet 28 between the surface of the aluminizing bath and the exit position of the cooling unit 29 are values inherent in the hot-dip aluminizing plant. In contrast, the length L3 between the cooling unit 29 and the solidification location C1 is a variable which changes depending on the amount of cooling air in the cooling unit 29 and the conveying velocity of the coated steel sheet 28.

The solidification location-detecting means 13 detects the complete solidification location and comprises temperature distribution-detecting means 37*a*, imaging means 37*b* and image-displaying means 38. The temperature distribution-detecting means 37*a* is, for example, a two-dimensional infrared camera, and detects the two-dimensional temperature distribution of the coating layer in a field of vision 42 and sends output signals to the imaging means 37*b*. The image-displaying means 38 displays the two-dimensional temperature distribution of the coating layer as an image in response to output from the imaging means 37*b*, and detects the location of solidification of the coating layer with reference to the displayed image.

Figure 6:
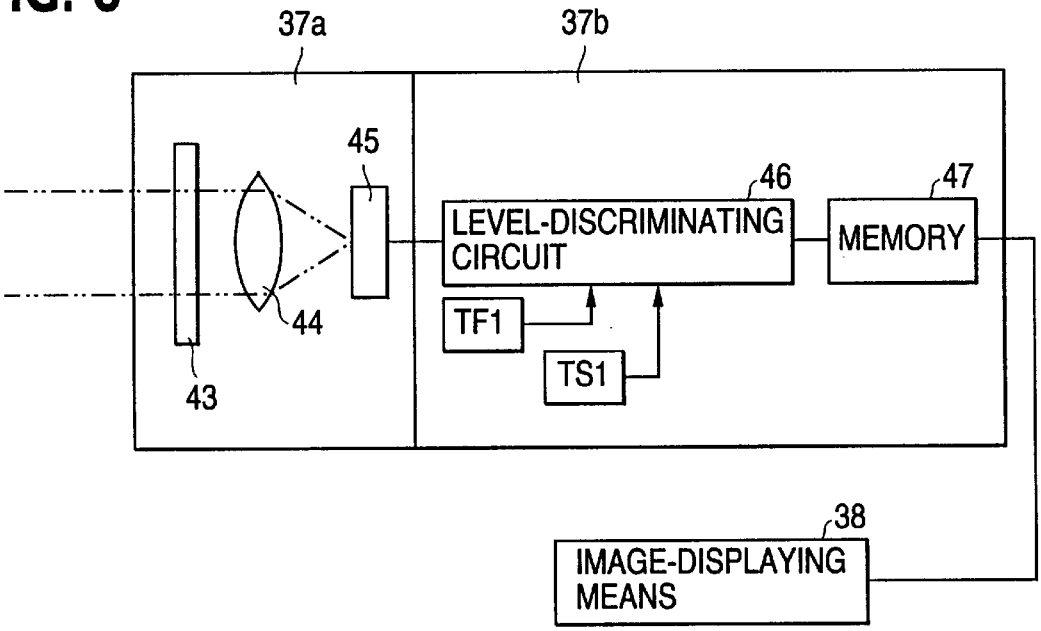
FIG. 6 is a simplified schematic diagram illustrative of the temperature distribution-detecting means and the imaging means.

FIG. 6 is a simplified schematic diagram illustrative of the temperature distribution-detecting means and the imaging means. An infrared camera 37*a*, as the temperature distribution-detecting means, comprises an infrared filter 43, a condensing lens 44 and a CCD (charge-coupled device) 45. The imaging means 37*b* is composed of a level discriminating circuit 46 and a memory 47. Infrared rays emitted from the coated steel sheet 28 are condensed by the condensing lens 44 via the infrared filter 43 and focused into an image on the CCD 45. The CCD 45 is an array of a plurality of photo detectors in a matrix. The photo detectors at the respective locations output electric signals which correspond to the infrared intensities of the formed images. Outputs (infrared intensities LV) from the respective photo detectors are sent to the level discriminating circuit 46 for level discrimination based on predetermined level-discrimination values. A level discrimination value TS1 of infrared intensity which corresponds to the solidification-start temperature and a level-discrimination value TF1 of infrared intensity which corresponds to the solidification-finish temperature are preset for the level-discriminating circuit 46. Therefore, the infrared intensities LVs are classified into the following three regions (R1, R2 and R3).

TABLE 2

| Region | Level of infrared intensity (LV) |
|---|---|
| R1 | $LV \geqq TS1$ |
| R2 | $TF1 < LV < TS1$ |
| R3 | $0 \leqq LV \leqq TF1$ |

Specifically, region R1 is the region in which the coating layer has completely melted, region R3 is the region in which the coating layer has completely solidified, and region R2 is the region in which a solid and a liquid are present together. The level-discriminated infrared intensities LVs are sent to the memory 47 and stored. The stored infrared intensities LVs are sent to the image displaying means 38 to be displayed on a cathode-ray tube or the like as images 41 which will be described later.

Figure 7:
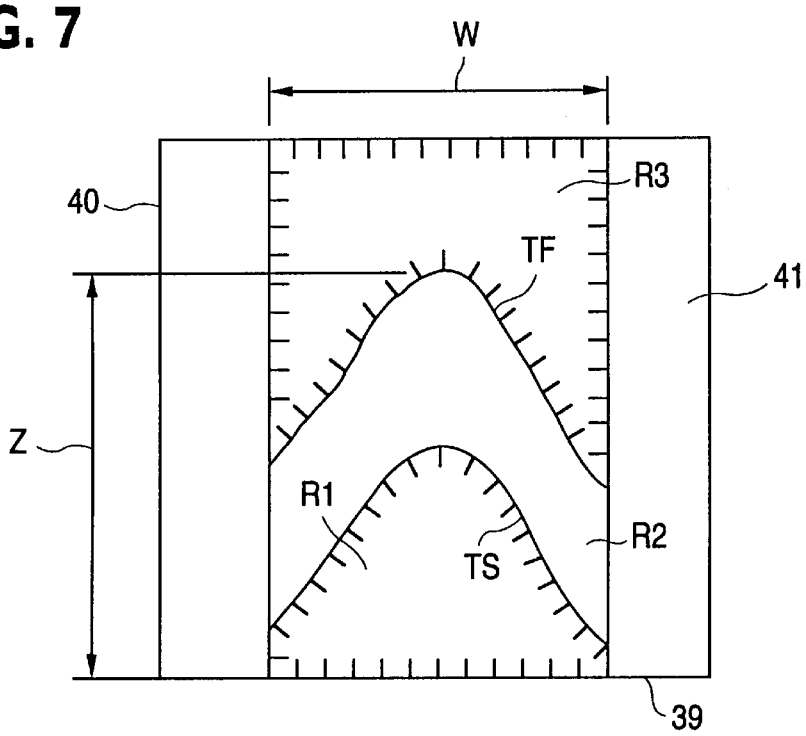
FIG. 7 is a view illustrative of an image displayed by the solidification location-detecting means.

FIG. 7 is a view illustrative of an image displayed by the solidification location-detecting means. Plotted along the x-axis 39 are locations along the sheet width W of the coated steel sheet, while the y-axis 40 represents locations along the conveying direction of the coated steel sheet 28 relative to the top surface of the cooling unit 29 as the reference surface. Therefore, the lowermost point of the y-axis 40 in FIG. 7 corresponds to the level of the top surface of the cooling unit 29, while upper positions on the y-axis 40 represent points downstream in the conveying direction of the coated steel sheet 28.

Since the cooling rate of the coated steel sheet 28 increases toward its two ends along the sheet width W, the two ends along the sheet width W solidify further at the upstream side (lower side in FIG. 7) than the center portion along the sheet width W. Therefore, the curve TS which shows the isothermal curve of the solidification-start temperatures of the coating layer and the curve TF which shows the isothermal curve of the solidification-finish temperatures of the coating layer are roughly parabolas which project upwards, as shown in FIG. 7. Since the solidification completion location of the coating layer matches the location of the peak of the curve TF which indicates the location of final solidification, the solidification completion location of the coating layer is determined by, for example, determining location Z along the y-axis 40 at which the curve TF has a zero-degree slant, by differentiation, and converting length Z on the image into an actual length L3. Here, in FIG. 7, region R1 is the region upstream from the curve TS, region R3 is the region downstream from the curve TF, and region R2 is the region between the two regions.

Since the solidification location-detecting means 13 detects the solidification completion location in this way with reference to the two-dimensional temperature distribution, the location of the final solidification may be reliably detected even with its movement along the sheet width W and/or in the conveying direction, thus allowing exact and reliable detection of the solidification completion location of the coating layer.

Referring to FIG. 4 again, the velocity-detecting means 14 is a pulse generator, for example. The pulse generator 14 is provided at the bridle rolls 31*b,* and serves to exactly determine the conveying velocity of the coated steel sheet 28 on the basis of the number of pulses counted for a predetermined time. The flow rate-detecting means 15 is an air-flow meter which detects the flow rate of the air used to cool the coated steel sheet 28. The air-flow meter 15, which is provided in the air duct 34, accurately detects the rate of the cooling air at the cooling-unit 29 side of the flow rate control valve 35. The flow rate control means 20, which is, for example, an air-flow control device, controls the rate of the cooling air in the cooling unit 29 in response to the value instructed for the rate of the cooling air. A velocity control device 21 used as the velocity control means controls the conveying velocity of the coated steel sheet 28 on the basis of the value instructed for the conveying velocity.

The setting means 17 is a keyboard or the like, and sets settings for the operating means 18 and the control means 19 in advance. The operating means 18 is a microcomputer, for example, and calculates a first elapsed time from the time of immersion of the base-metal steel plate 23 into the aluminizing bath 25 to the completion of solidification of the coating layer which has passed through the bath, and a second elapsed time from the time of completion of guiding of the coated steel sheet 28 out of the aluminizing bath to the completion of solidification of the coating layer. The control means 19 is, for example, a processing computer, and controls the flow rate control means 20 and the velocity control means 21 so that the thickness of the alloy layer and the value reflecting the section pattern of the coated steel sheet 28 match the desired values. Here, the value reflecting the section pattern is the maximum differential unevenness of thickness of the alloy layer or the score reflecting the section pattern of the alloy layer, as will be described later.

Figure 8:
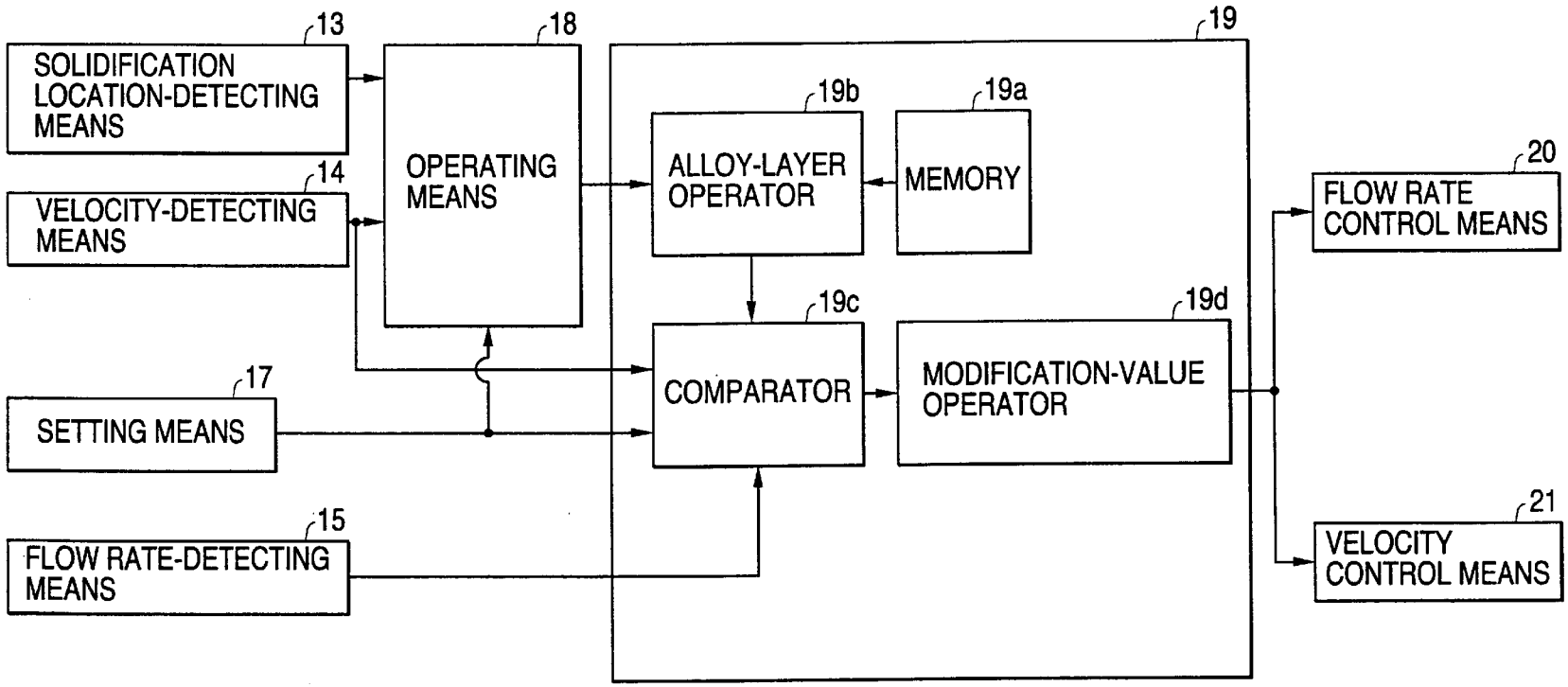
FIG. 8 is a block diagram illustrative of the electric configuration of the alloy-layer control apparatus.

FIG. 8 is a block diagram illustrative of the electric configuration of the alloy-layer control apparatus. The solidification location-detecting means 13 detects the location L3 of completion of solidification of the coating layer and sends the detected value to the operating means 18. The velocity-detecting means 14 detects the conveying velocity V of the coated steel sheet 28 and sends the detected value to the operating means 18 and to the control means 19 which is a processing circuit. The setting means 17 sets the conveying lengths L1 and L2, which are values inherent in the coating plant 8 or aluminizing plant. The setting means 17 also sets, in the operating means 18, a maximum for the flow rate F of the cooling air in the cooling unit 29 and a maximum for the conveying velocity V in the control means 19, and further sets a desired thickness TA for the alloy layer and a desired value for the section pattern of the alloy layer in the control means 19. The flow rate-detecting means 15 detects the flow rate F of the cooling air in the cooling unit 29, and sends the detected value to the control means 19. The operating means 18 calculates the first elapsed time and the second elapsed time based on the detected values of the solidification completion location L3 of the coating layer, the conveying velocity V and the conveying lengths L1 and L2, and sends the results to the control means 19.

The control means 19 is equipped with a memory 19*a*, an alloy-layer operator 19*b*, a comparator 19*c* and a modification value operator 19*d*, and processes the respective received signals to output control-instruction signals. Regression equations which are described later and others are prestored in the memory 19*a*. As described later, the regression equations represent the correlation between the first elapsed time and the thickness of the alloy layer, and the correlation between the second elapsed time and the value which reflects the section pattern of the alloy layer. The alloy-layer operator 19*b* substitutes the first elapsed time and the second elapsed time which are outputted from the operating means 18, into the regression equations stored in the memory 19*a* to calculate the thickness of the alloy layer and the value which reflects the section pattern of the alloy layer, respectively.

The comparator 19*c* performs comparisons between the values calculated by the alloy-layer operator 19*b* and the respective desired values set by the setting means 17. The comparator 19 further performs comparisons between outputs from the flow rate-detecting means 15 and the velocity-detecting means 14 and the maximum flow rate of the cooling air and the maximum conveying velocity set by the setting means 17 in cases where the calculated values do not match the desired values. As a result, when the flow rate of the cooling air is lower than the maximum, a signal for modifying the flow rate of the cooling air is outputted. In addition, when the flow rate of the cooling air has reached the maximum, and the conveying velocity is lower than the maximum, a signal for modifying the conveying velocity is outputted. The modification value operator 19*d* calculates a modified flow rate of the cooling air or a modified conveying velocity in response to the output from the comparator 19*c* to output an instruction signal to the flow rate control means 20 or the velocity control means 21. The foregoing processing is repeated until the calculated values match the desired values.

In response to the output from the control means 19, the flow rate control means 20 adjusts the flow rate control valve 35 to control the flow rate of the cooling air in the cooling unit 29 so as to match the instructed value. In response to the output from the control means 19, the velocity control means 21 adjusts the drive motor 32 of the bridle rolls 31*b* to control the conveying velocity so as to match the instructed value. Since the alloy-layer control unit 11 operates in this way on the basis of a rational algorithm, the thickness of the alloy layer of the coated steel sheet 28 and the value which reflects its section pattern may be precisely controlled so as to match the desired values.

Figure 9:
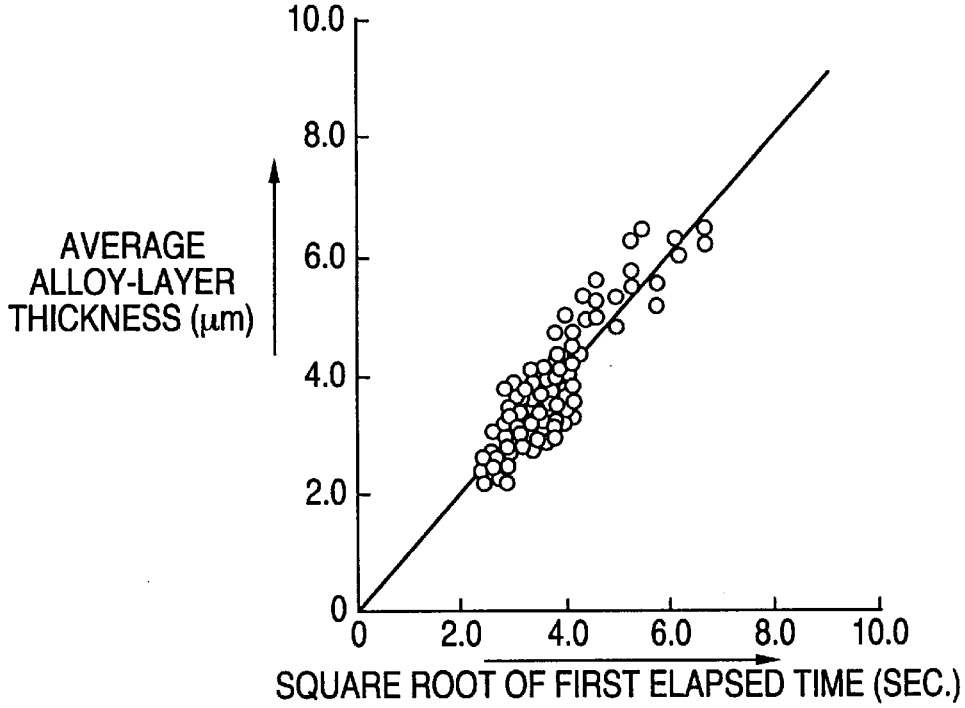
FIG. 9 is a correlation diagram illustrative of the correlation between the first elapsed time and the average thickness of the alloy layer of the hot-dip aluminized steel sheet.

FIG. 9 is a correlation diagram illustrative of the correlation between the first elapsed time and the thickness of the alloy layer of the hot-dip aluminized steel sheet. The thickness of the produced alloy layer has a clear first-order correlation with the square root of the first elapsed time, and its regression equation is represented by Equation (1) below where the thickness of the alloy layer is represented by T, and the square root of the first elapsed time t1 is represented by Rt1.

$$T=1.02Rt1 \quad (1)$$

Since the correlation coefficient of Regression Equation (1) is 0.860, the correlation is judged to be very high. Therefore, the thickness of the alloy layer decreases as the first elapsed time becomes shorter (the solidification time becomes shorter). Here, Regression Equation (1) is prestored in the memory 19*a* of the control means 19. The correlation between the thickness of the produced alloy layer and the first elapsed time may be explained as follows.

The production of the alloy layer of the coated steel sheet is the result of diffusion of the Fe atoms in the base-metal steel sheet into the coating layer, In cases where the diffusion coefficient D in Fick's second law of diffusion is constant regardless of the location, the law is represented by Equation (2). When it is considered that the diffusion length is shorter than the original distribution state of the concentration (actually there are few cases where the alloy layer grows so far as to reach the surface of the coating layer, and thus the thickness of the alloy layer is small when compared with the entire coating layer), the solution to Equation (2) may be represented by Equation (3) based on a Gauss' error function.

$$\delta c/\delta t = D\delta^2 c/\delta x^2 \quad (2)$$

wherein c=Fe concentration, t=time, D=diffusion coefficient, and x distance from the interface.

$$(Cx - Co)/(Cs - Co) = 1 - erf\left(x/2\sqrt{(Dt)}\right) \quad (3)$$

wherein Cs=Fe concentration in the interface between the base-metal steel sheet and the coating layer, Cx=Fe concentration at the point with a distance x from the surface of the base-metal steel sheet, and Co=initial Fe concentration of the coating layer.

The Fe concentration represented by Cs may be assumed to be 100%, while the Fe concentration represented by Co may be assumed to be 0%, and the Fe concentration in the growth front of the hot-dip aluminized steel sheet product is measured to be approximately 30%. Therefore, Equation (3) is arranged as Equation (4) below by substituting 100, 0 and 30 for Cs, Co and Cx in Equation (3). Here, y which satisfies erf(y)=0.7 is determined to be 0.733 according to Equation (5) given below which is a Gauss' error function. Substitution of this value into Equation (4) results in Equation (6).

$$erf\left(x/\left(2\sqrt{(D\cdot t)}\right)\right) = 0.7 \quad (4)$$

$$erf(y) = 2/\sqrt{\pi}\int_0^y \exp(-x^2)dx \quad (5)$$

$$x = 1.466\times\sqrt{D}\cdot\sqrt{t} \quad (6)$$

In addition, though being a function of temperature, the diffusion coefficient D [=Do exp(Q/RT)] may be considered to be almost constant so long as the solidification time varies only within a range which is encountered during practical operation for a continuous, hot-dip aluminizing line. This is because coating (aluminizing) baths in practical use are controlled so as to maintain a predetermined range of temperatures (a desired temperature ±ca. 15° C.) at all times. In addition, the bath compositions are controlled so as to be kept constant as well. Thus, it may be considered that the solidification temperature of the coating layer is almost constant, and the average temperature of the coating layer during solidification is constant regardless of the cooling rate. Consequently, D may be considered to be a constant, and Equation (6) may be arranged as Equation (7) below by replacing 1.466 x √D by a coefficient ∝.

$$x = \alpha\sqrt{t} \quad (7)$$

wherein x=alloy-layer thickness (cm), t=time (sec.), and ∝=coefficient (_(cm²/sec.)).

Equation 7 indicates that the thickness x of the produced alloy layer is proportional to the square root t of the time. Here, since diffusion is much more accelerated in liquids than in solids, the reaction for the production of the alloy layer (infiltration of the Fe atoms in the base-metal steel sheet into the coating layer through diffusion) using a high-speed, short-time processing plant such as a continuous, hot-dip aluminizing line may be considered to be proportional to the square root of the time during which the coating layer is in a liquid state (the time elapsed from the time of guiding the base-metal steel sheet into the coating bath to the time of completion of solidification of the coating metal layer which has passed through the bath). In view of these considerations, the result of correlating the thicknesses of the coating layers of coated steel sheets (types of materials: extremely low-carbon titanium containing steel, medium-carbon and low-carbon aluminum killed steel, rimmed steel, etc.; sheet thickness: 0.4–3.2 mm; coating-layer thickness: 10–45 μm; on a single surface) which were actually manufactured, with the square roots of the first elapsed times is illustrated in the correlation diagram of FIG. 9 (α in Equation (7) =1.02 (√(μm$^{2/sec.}$)).

The diffusion coefficient D=4.98×10$^{-9}$ (cm²/sec.) is calculated from the result. Since it is known that metals of face-centered cubic lattices usually have self diffusion coefficients of 10$^{-8}$–10$^{-9}$ cm²/sec. at their melting points, the value of D mentioned above is judged to be a proper value.

Since the correlation between the alloy-layer thickness and the first elapsed time which is illustrated in FIG. 9 may be applied regardless of the type of the material of the base-metal steel sheet, the sheet thickness, the sheet temperature, the coating-layer thickness, etc., the thickness of the produced alloy layer may be precisely controlled by mere adjustment of the first elapsed time. Thus there is no need to consider the thickness of the base-metal steel sheet and the cooling rate which is related to the sheet thickness. Nor is there a need to adjust the sheet temperature during immersion into the coating bath or to take troublesome measures such as precoating of the steel sheet surface with a specific metal layer.

Figure 3:
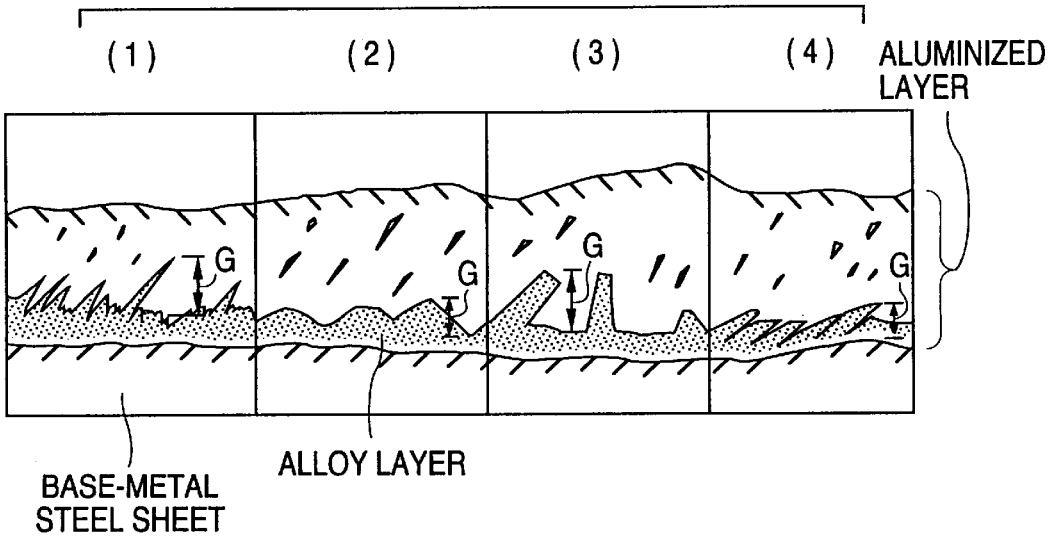
FIG. 3 is a view illustrative of a method of calculating the maximum differential unevenness of thickness of the alloy layer.
Figure 10:
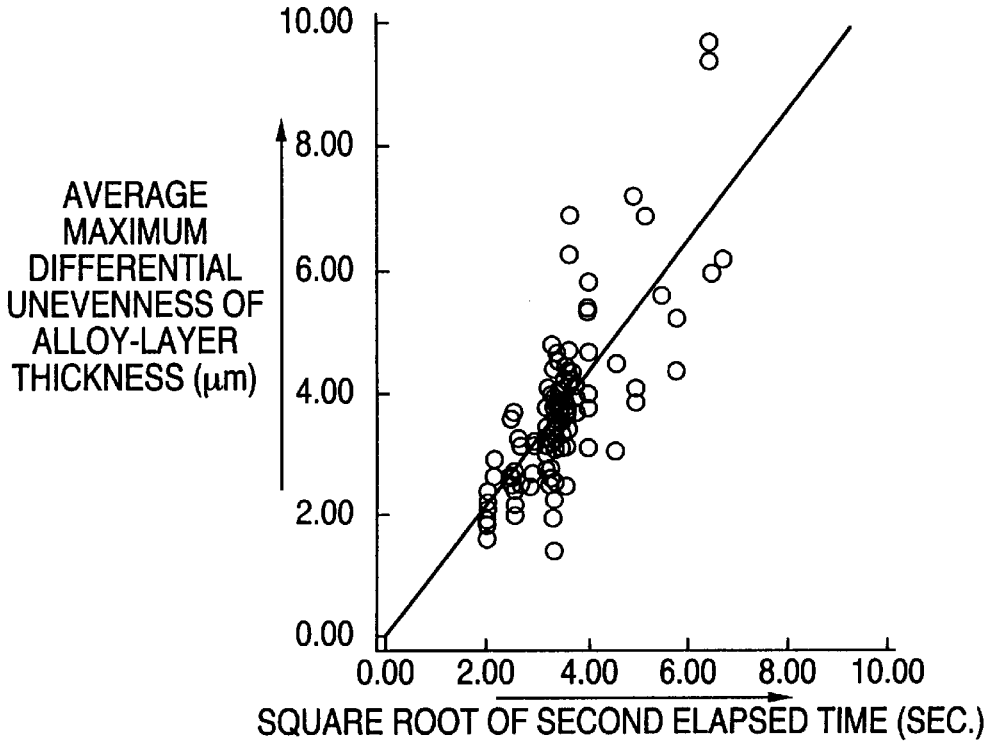
FIG. 10 is a correlation diagram illustrative of the correlation between the second elapsed time and the average maximum differential unevenness of thickness of the alloy layer of the hot-dip aluminized steel sheet.

FIG. 10 is a correlation diagram illustrative of the correlation between the second elapsed time and the maximum differential unevenness of thickness of the alloy layer of the hot-dip aluminized steel sheet. The maximum differential unevenness of thickness of the alloy layer is one of the values which reflect the section pattern of the alloy-layer, which is determined as illustrated in FIG. 3. The maximum differential unevenness of thickness of the alloy layer has an apparent first-order correlation with the second elapsed time, and the regression equation may be given as Equation 8 below when the maximum differential unevenness of thickness of the alloy layer is represented by G, and the square root of the second elapsed time is represented by Rt2.

$$G = 1.113Rt2 - 0.094 \quad (8)$$

Since the correlation coefficient r of the Regression Equation is 0.758, the correlation is very high. Therefore, the maximum differential unevenness of thickness G of the alloy layer decreases to provide a flatter section pattern as the second elapsed time is shortened (or the solidification time is shortened).

Figure 11:
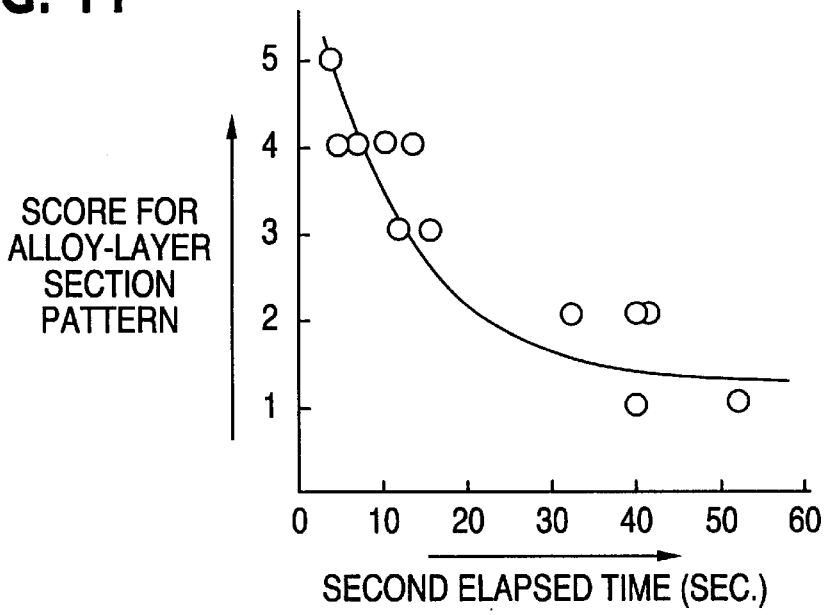
FIG. 11 is a correlation diagram illustrative of the correlation between the second elapsed time and scores for the section pattern of the alloy layer.
Figure 12:
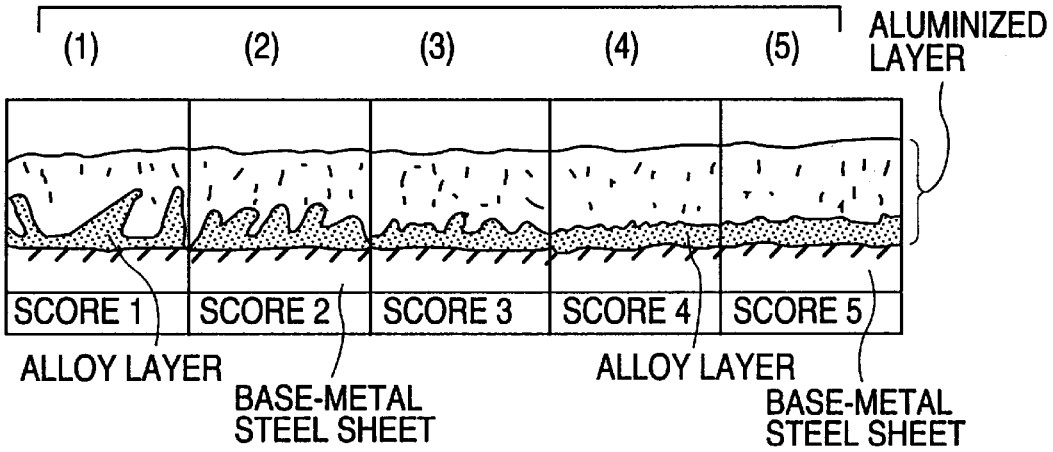
FIG. 12 is a view illustrative of the scores for the section pattern of the alloy layer.

FIG. 11 is a correlation diagram illustrative of the correlation between the second elapsed time and the score for the section pattern of the alloy layer. The score for the section pattern of the alloy layer is one of the values which reflect the section pattern of the alloy layer; the section pattern of the alloy layer is ranked in a five-level score, as illustrated in FIGS. 12(1) through (5). Specifically, score 1 of the five-level score reflects the section pattern of FIG. 12(1) which has the greatest differential unevenness of thickness of the alloy layer, while score 5 reflects the section pattern of FIG. 12(5) which is the flattest alloy layer.

FIG. 11 shows that the section pattern of the alloy layer has a clear correlation with the second elapsed time. FIG. 11 further indicates that a shorter second elapsed time (the shorter solidification time) results in the formation of a flatter section pattern. As described above, since both the maximum differential unevenness of thickness G of the alloy layer and the score for the section pattern of the alloy layer which reflect the section pattern of the alloy layer have correlations with the second elapsed time, the section pattern of the alloy layer may be controlled to have a higher level of flatness by adjustment of the second elapsed time. Here, Regression Equation (8) and the correlation of FIG. 11 are prestored in the memory 19*a* of the control means 19. The correlation between the section pattern of the alloy layer and the second elapsed time may be explained as follows.

Figure 13A:
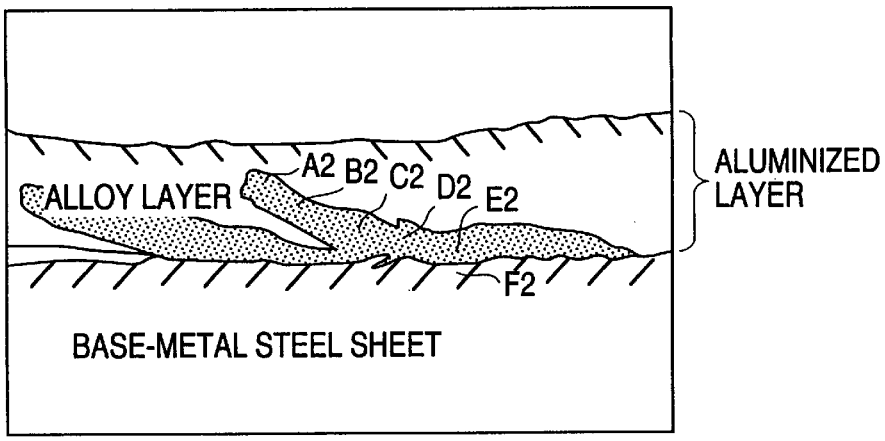
FIGS. 13(*a*)–(*b*) are views illustrative of the concentration distribution of components of the alloy layer.
Figure 13B:
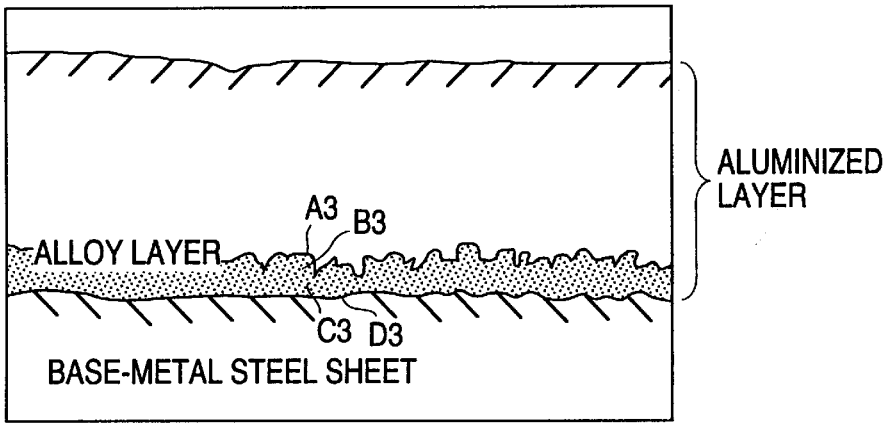

FIG. 13 is a view illustrative of the distribution of the concentrations of components of the alloy layer. A comparison of the distributions of the Fe and Si concentrations in flat sections of the alloy layers between an alloy layer with a great sectional unevenness (which corresponds to score "1" in FIG. 12) as shown in FIG. 13(1) and a flatter alloy layer (which corresponds to score "4") as shown in FIG. 13(2) reveals that the two Fe concentrations differ little from each other and are approximately 30%, and the Si concentrations in the portions of the alloy layers which are near the interfaces with the base-metal steel sheets (position E2 and position B3) are almost identical and are approximately 12%. However, the Si concentration on the order of 17% in a protruding portion (position A2) of the section with a greater unevenness indicates that the section is more rich in Si than the corresponding section of the flatter alloy layer.

Figure 14:
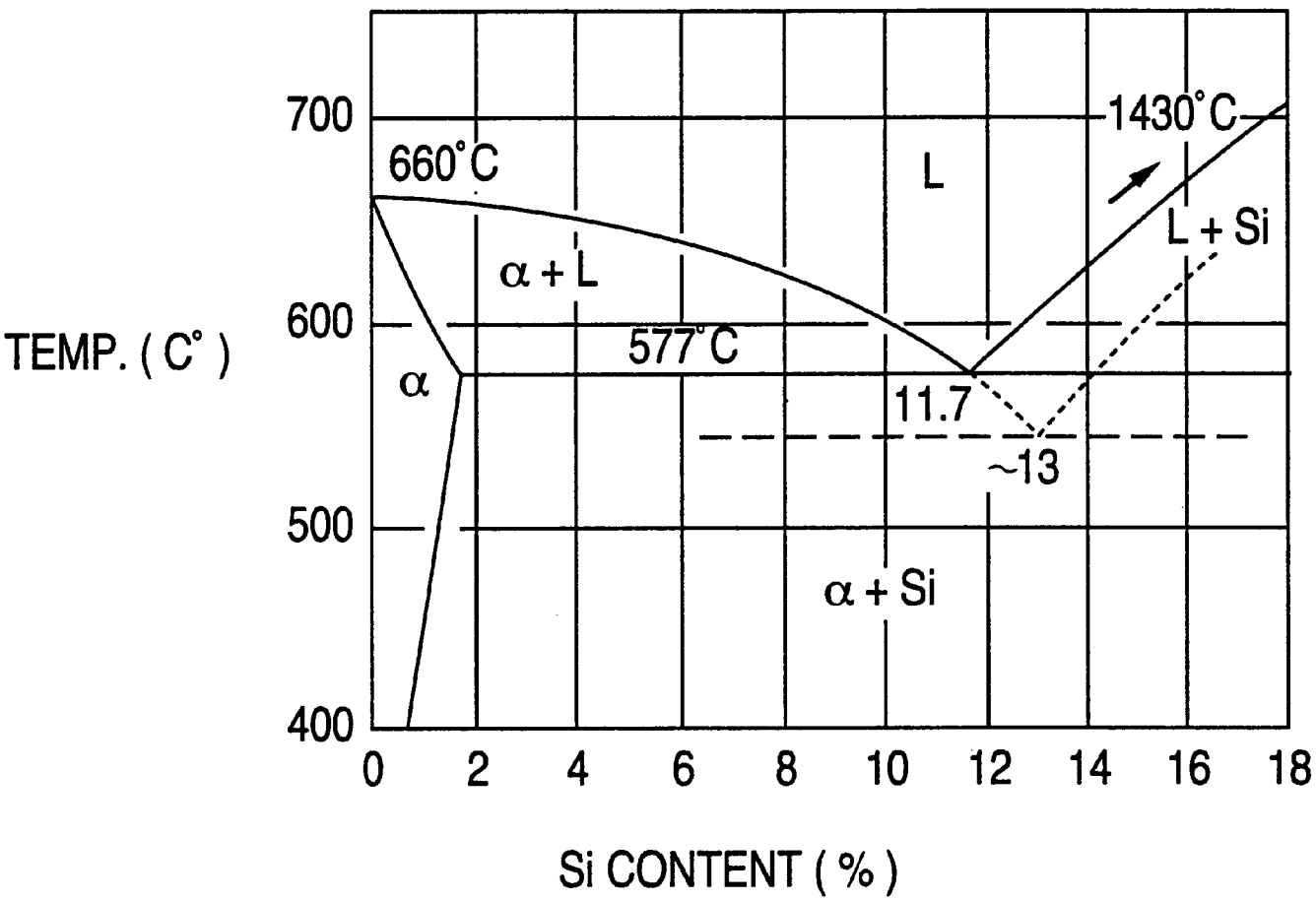
FIG. 14 is an Al—Si equilibrium diagram.

When this Si concentration distribution is considered with reference to the Al—Si equilibrium diagram of FIG. 14, since a primary crystal α (the solubility limit of Si is 12% by weight which is lower than the Si concentration in the aluminizing bath) precipitates while discharging Si into the melt during the process of solidification of the Al—Si coating layer, the Si concentration in the final solid portion of the melt is higher than in the other portions.

Figure 15A:
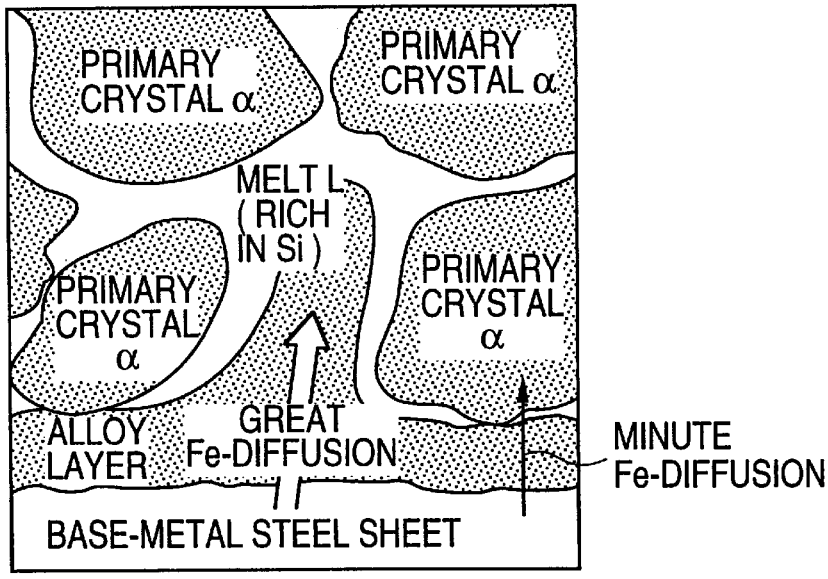
FIGS. 15(*a*)–(*b*) are views illustrative of the growing process of the alloy layer in the aluminized layer.
Figure 15B:
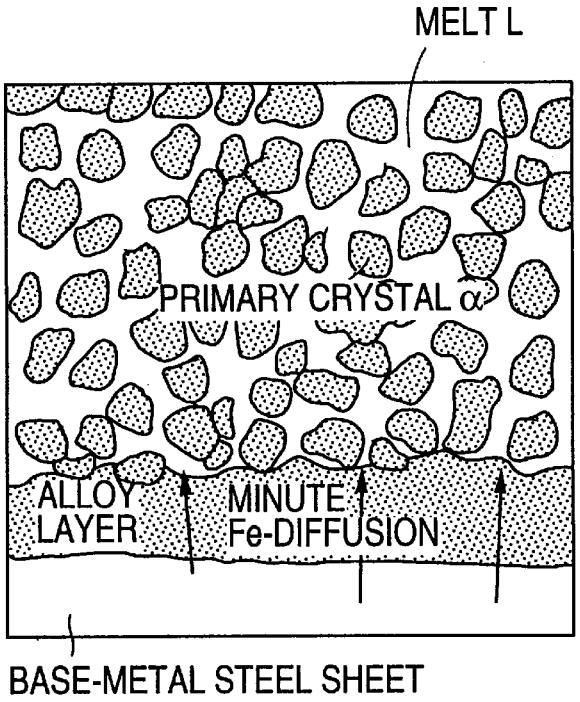

The process of solidification will now be explained by comparing the case where the solidification time of the coating layer is rather long and the case where the solidification is completed in a short time. When the solidification time is long, since the Si atoms have enough time to move through the melt by dispersion, and a satisfactory distribution of the Si atoms is established between the primary crystal and the solution, the primary crystal α grows large, while Si is condensed in the nonsolidified portions of the melt L, as illustrated in FIG. 15(*a*). As a result, the growth of the alloy layer (diffusion of the Fe atoms) on the section of the surface of the base-metal steel sheet which is in contact with the primary crystal α is retarded (due to a solid/solid diffusion reaction). In contrast, the Fe atoms in the base-metal steel sheet diffuse into the alloy layer resulting in rapid growth on the portion of the surface of the base-metal steel sheet which is not in contact with the primary crystal α (due to a solid/liquid diffusion reaction). The portion depending difference in the rates of the diffusion reactions results in the formation of the uneven section pattern of the alloy layer. The degree of unevenness increases as the solidification time is lengthened.

On the other hand, where the solidification time is short, the movement of the Si atoms in the melt and the primary crystal by diffusion is prevented, many primary crystals a are produced, and the solidification proceeds with a large number of fine primary crystals a distributed uniformly throughout the melt L, as illustrated in FIG. 15(*b*). Accordingly, unlike the case in which the solidification proceeds slowly, the difference in the growth rates of the portions of the alloy layer is reduced, and this results in formation of a section pattern with a lower degree of unevenness (a flatter section pattern).

Figure 16:
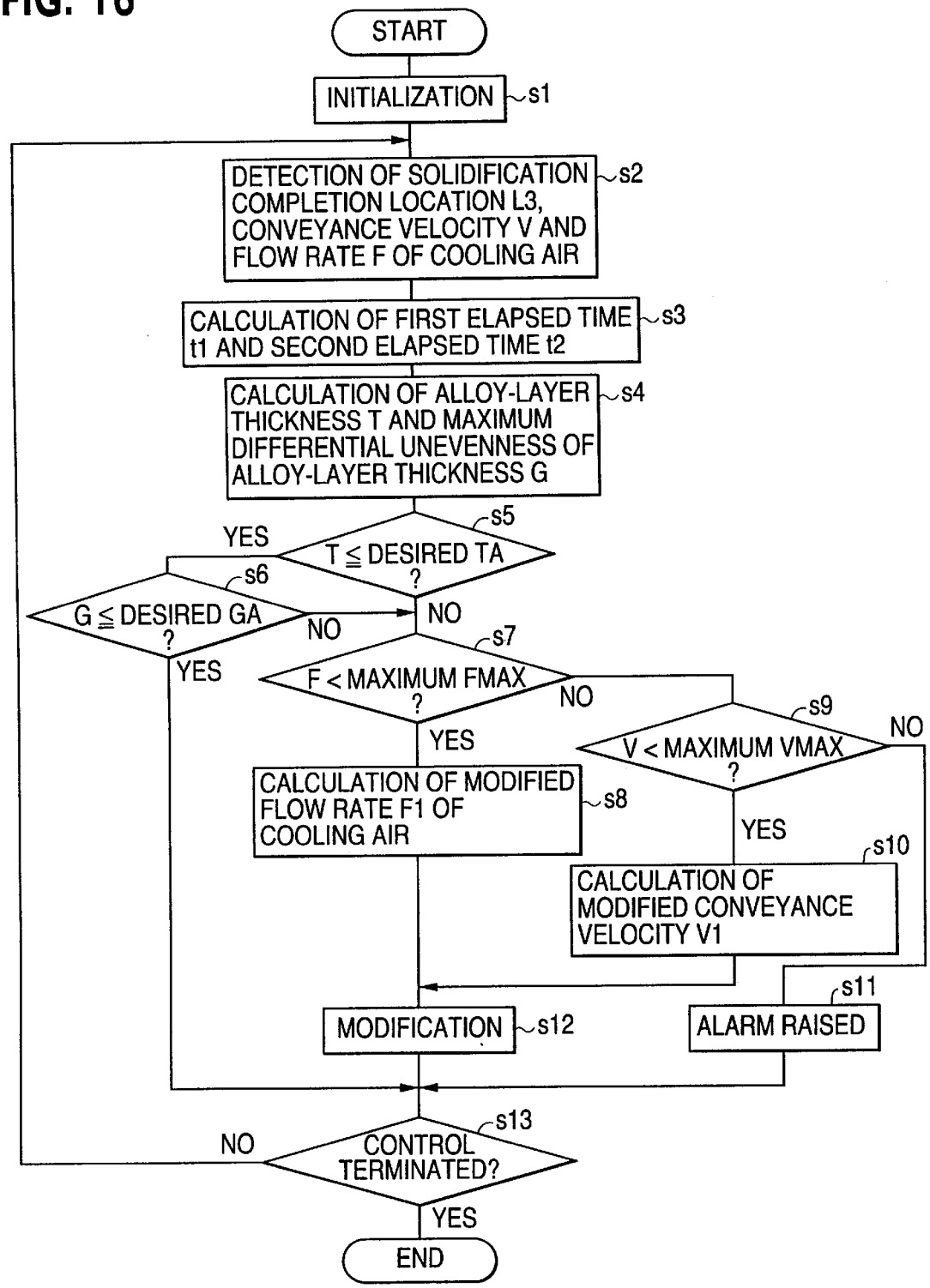
FIG. 16 is a flow chart illustrative of the operation of the alloy-layer control apparatus.
Figure 17:
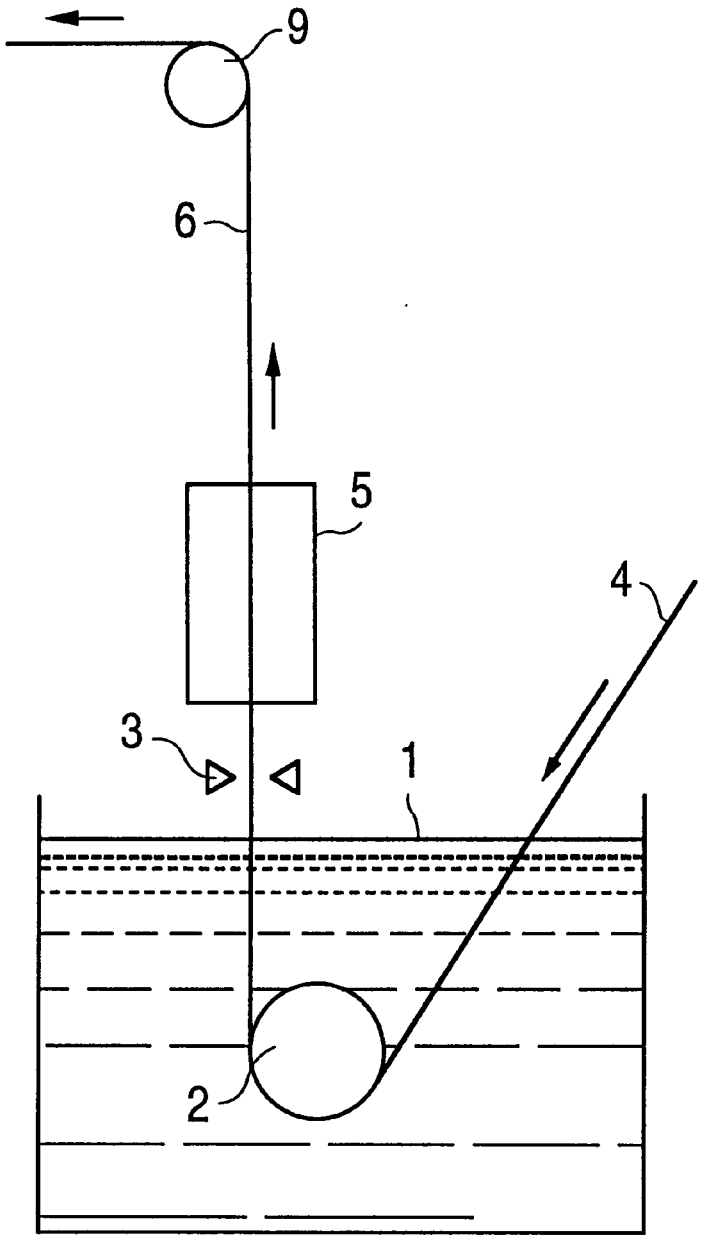
FIG. 17 is a simplified schematic view illustrative of a continuous, hot-dip aluminizing plant of the prior art.

FIG. 16 is a flow chart illustrative of the operation of the alloy-layer control apparatus. A method of controlling an alloy layer on a hot-dip aluminized steel sheet will be explained with reference to FIG. 16. In step s1, prior to the control of the alloy layer, the desired values, the values inherent in the plant and the settings are initialized. The desired values include a desired value TA for the thickness of the alloy layer, a desired value GA for the maximum differential unevenness of thickness of the alloy layer and a desired score for the section pattern of the alloy layer and are initialized to predetermined values. These desired values are determined depending on the amount of deposition of the coating, the degree of peeling resistance of the coating layer which is required by consumers for press working, etc. The desired values include, for example, TA=4 gm, GA=5 gm, and the score for the section pattern=4. The values inherent in the plant include the conveyance lengths L1 and L2, a maximum flow rate MAX for the cooling air in the cooling unit 29 and a maximum conveyance transport velocity VMAX for the coated steel sheet 28 and are initialized to values which are determined by specifications of the hot-dip aluminizing line. The settings, which include an air-flow modification value AF and a velocity modification value AV, are initialized to values which are determined on the basis of the past performance. Of these, the air-flow modification value AF and the velocity modification value AV are unit modification values which are used to modify the flow rate of the cooling air and the conveying velocity step by step. According to the present embodiment, the modification values are often used as increment modification values for shortening the solidification time of the coating layer, as described later.

In step s2, the solidification completion location L3 of the coating layer, the conveying velocity V of the coated steel sheet 28 and the flow rate F of the cooling air of the cooling unit 29 are detected, respectively. Their detection is performed with the solidification location-detecting means 13, the velocity-detecting means 14 and the flow rate-detecting means 15. In step s3, the first elapsed time tl and the second elapsed time t2 are calculated. The calculation of the first and the second elapsed times t1 and t2 are performed by the operating means 18 according to Equations (9) and (10) given below.

$$t1=(L1+L2+L3)/V \tag{9}$$

$$t2=(L2+L3)/V \tag{10}$$

In step s4, the thickness T of the alloy layer of the coated steel sheet 28 and the maximum differential unevenness of thickness G are calculated. Their calculation is performed by substituting the elapsed times t1 and t2 calculated in step s3 into Regression Equations (1) and (2) defined above. Here, the maximum differential unevenness of thickness G of the alloy layer may be replaced by the score for the section pattern of the alloy layer. In this case, the score for the section pattern of the alloy layer which corresponds to the second elapsed time t2 is determined on the basis of the correlation illustrated in FIG. 11.

In step s5, it is judged whether the thickness T of the alloy layer calculated in step s4 is no more than the desired value TA. The process proceeds to step s6 when the judgment is positive, and proceeds to step s7 when the judgment is negative. In step s6, it is judged whether the maximum differential unevenness of thickness G of the alloy layer calculated in step s4 is no more than the desired value GA. When the judgment is positive, since both the thickness T and the maximum differential unevenness of thickness G of the alloy layer are determined to match the desired values, the hot-dip aluminizing is continued, and the process proceeds to step s13. When the judgment is negative in step s6, the process proceeds to step s7.

In step s7, it is judged whether the flow rate F of the cooling air detected in step s2 is lower than the maximum flow rate MAX of the cooling air. When the judgment is positive, since the solidification time may be shortened by increasing the flow rate of the cooling air, the process proceeds to step s8 for modification of the flow rate of the cooling air. In step s8, a modified flow rate F1 of the cooling air is determined. The modified flow rate F1 of the cooling air is calculated according to Equation (11) given below, based on the flow rate F of the cooling air detected in step s2 and the air-flow modification value AF set in step s1.

$$F1=F+\Delta F \tag{11}$$

The process proceeds to step s12 after the modified flow rate F1 of the cooling air has been calculated. When judgment is negative in step s7, the process proceeds to step s9 on the judgment that the flow rate of the cooling air has reached the maximum, and thus the solidification time cannot be shortened any more by adjustment of the flow rate of the cooling air. In step s9, it is judged whether the conveying velocity V is lower than the maximum transport velocity VMAX. When the judgment is positive, since the conveying velocity may be increased to shorten the solidification time, the process proceeds to step s10 for modification of the conveying velocity. In step s10, the modified conveying velocity V1 is determined. The modified conveying velocity V is calculated according to Equation (12) given below, based on the conveying velocity V detected in step s2 and the velocity modification value V set in step s1.

$$V1=V+\Delta V \tag{12}$$

The process proceeds to step s12 after the modified conveying velocity V1 has been calculated. In step s12, the flow rate F of the cooling air or the conveying velocity V is modified. That is, when the judgment is positive in step s7, the flow rate F of the cooling air is modified, whereas the conveying velocity V is modified in cases where the judgment is negative in step s7 and positive in step s9. The modification of the flow rate F of the cooling air is performed through adjustment of the degree of the valve opening of the flow rate control valve 35 of the cooling unit 29 so that the flow rate F of the cooling air is equal to the modified flow rate F1 of the cooling air determined in step s8. The conveying velocity V is modified by adjusting the revolution rates of the drive motor 32 for the bridle rolls 31*b* so that the conveying velocity V is equal to the modified conveying velocity V1 determined in step s10. The process proceeds to step s13 after the modification has been completed in step s12.

When the judgment is negative in step s9, the process proceeds to step s11 on the judgment that the conveying velocity has reached the maximum, and thus the solidification time cannot be shortened any more. An alarm is raised in step s1. The alarm is raised with a visual indicator such as a flashing red lamp indicator or with an acoustic indicator such as a buzzer. Since the hot-dip aluminized steel sheet for which an alarm has been raised has the possibility of having a greater thickness or a greater maximum differential unevenness of thickness of the alloy layer than the desired value, the sheet undergoes more detailed investigation of the quality to determine measures to be taken. The process proceeds to step s13 after an alarm has been raised.

In step s13, it is judged whether the control of the alloy layer has been terminated. This judgment is performed based on whether the tail of the coil of the hot-dip aluminized steel sheet 28 has reached the cooling unit 29 at which the control is performed. When the judgment is negative, the control is maintained, and the process proceeds to step s2. The loop which starts and ends with step s2 via step s13 is repeated until the judgment becomes positive in step s13. In cases where the judgment is positive in step s13, since the tail of the coil has reached the location of control, the control for a coil of the alloy layer is complete.

As described above, according to the present embodiment, the location of completion of the solidification of the coating layer is detected to calculate the first elapsed time and the second elapsed time up to the completion of the solidification. In addition, the thickness T of the alloy layer which corresponds to the first elapsed time is determined on the basis of the correlation illustrated in FIG. 9. Furthermore, the maximum differential unevenness of thickness G of the alloy layer or the score for the section pattern of the alloy layer which corresponds to the second elapsed time is determined on the basis of the correlation illustrated in FIG. 10 or FIG. 11, and either or both the flow rate F of the cooling air in the cooling unit 29 and the conveying velocity V of the coated steel sheet 28, which are operational conditions, is repeatedly modified until the calculated values match the desired values. Since the control of the alloy layer is performed as feedback control, the thickness and the section pattern of the alloy layer is precisely and reliably controlled. More specifically, the control of the alloy layer, so that the layer thickness is no more than 4 gm, the maximum differential unevenness of thickness is no more than 4 gm and the score for the section pattern is no less than 4, may be accomplished by controlling the flow rate of the cooling air and the conveying velocity so that the first elapsed time is 16 seconds or less and the second elapsed time is 10 seconds or less. As a synergistic effect of the control of the thickness of the alloy layer and the control of the section pattern of the alloy layer, the peeling resistance of the coating layer is further increased, and this results in a greater degree of reliability during severe press working such as drawing or ironing. Therefore, hot-dip aluminized steel sheets with excellent peeling resistance of the coating (aluminized) layers may be manufactured efficiently and reliably according to the present embodiment.

According to another embodiment of the invention, the hot-dip aluminized steel sheet 28 may be manufactured through mere control of the thickness of the alloy layer, without needing to control both the thickness and the section pattern of the alloy layer of the coated steel sheet 28. Since the alloy-layer control apparatus according to the present embodiment is entirely the same as the alloy layer control apparatus 11, drawings and explanation thereof are omitted to avoid repetition. In addition, since the flow chart for the operation of the alloy-layer control apparatus according to the present embodiment is also the same as that of FIG. 16 except for the following points, drawings and explanation thereof are also omitted to avoid repetition. Specifically, the flow chart for the present embodiment is different from the flow chart illustrated in FIG. 16 in that step s6 for judgment of the section pattern of the alloy layer is omitted, and the reference to the second elapsed time and the maximum differential unevenness of thickness of the alloy layer which is given in step s1, step s3 and step s4 is omitted as well.

The control of the thickness of the alloy layer according to the present embodiment is accomplished, first, by detecting the location of solidification of the coating layer to calculate the first elapsed time up to completion of the solidification. Next, the present embodiment determines the thickness T of the alloy layer which corresponds to the first elapsed time on the basis of the correlation illustrated in FIG. 9. Finally, the present embodiment repeatedly modifies either or both the flow rate F of the cooling air in the cooling unit 29 and the conveying velocity V of the coated steel sheet 28 which are operational conditions, until the calculated value of the thickness of the alloy layer matches the desired value. Since the control of the alloy layer is performed as feedback control according to the present embodiment, the thickness of the produced alloy layer is precisely controlled. More specifically, the thickness of the alloy layer may be limited to no more than 4 μm by regulating the flow rate of the cooling air and the conveying velocity so as to provide a first elapsed time of 16 seconds or less. Therefore, the thickness of the alloy layer may be controlled depending on the degree of peeling resistance which is demanded by consumers for press working.

In order to produce the effect of preventing growth of the alloy layer by addition of S1, the hot-dip aluminizing bath which is used according to the invention is designed to have an Al—Si bath composition with a Si content of 3–13% by weight. The Si content must be 3% by weight at the least. Furthermore, a content of 6% by weight or more produces the effect of preventing the loss of the members immersed in the bath due to dissolution caused by corrosion. On the other hand, when the content exceeds 13% by weight, the corrosion resistance and the workability of the coating metal layer are impaired, and therefore 13% by weight is set as the upper limit. The bath composition may be adjusted in a manner which is not particularly different from the conventional operation for continuous hot-dip aluminizing. Here, although the Al—Si alloy bath usually contains Fe copresent in a proportion of approximately 5% by weight as an inevitable impurity, the effects of the invention are not impaired due to the copresence of the impurity.

The temperature of the coating bath must of course be higher than the melting point of the metal, and preferably is 20° C. higher than the melting point for increased stability of the quality of the coated surface. The upper limit of the coating-bath temperature is designed to be 70° C. higher than the melting point for the reason that baths at higher temperatures not only result in disadvantages in heat economy, but also accelerate the growth of the alloy layer, thereby failing to produce the effect of the invention of effectively controlling the growth of the alloy layer.

It is noteworthy that the invention provides means for controlling the thickness of the alloy layer and the section pattern of the alloy layer, which is effective not only for hot-dip aluminizing, but also for other continuous hot-dip coating (e.g., aluminum-zinc alloy coating, zinc-aluminum alloy coating, pure-aluminum coating, etc.). Furthermore, it is noteworthy, that the effect of controlling the section pattern of the alloy layer is particularly great when the hot-dip coating is effected with an alloy of two or more elements with mutual solubility limits.

EXAMPLES

Using a continuous hot-dip aluminizing line, a basemetal steel sheet 23 was conveyed into an aluminizing bath, and a coated steel sheet 28 guided out of the bath was forcedly cooled in a cooling unit 29 to manufacture a hot-dip aluminized steel sheet.

(A) Conditions for manufacture of test steel sheets (1) Types of base-metal steel sheet materials A: Extremely low-carbon titanium-added steel sheet Chemical composition (% by weight): C≦0.005, Si≦0.10, Mn: 0.10–0.20, P≦0.020, S≦0.010, Al: 0.04 0.06, Ti: 0.05–0.07 and N≦0.005.

Sheet thickness: 0.4–3.2 mm

B: Low-carbon aluminum killed steel sheet

Chemical composition (% by weight): C≦0.08, Si≦0.10, Mn: 0.10–0.40, P≦0.020, S≦0.030, Al: 0.02 0.06 and N≦0.005.

Sheet thickness: 0.7–2.2 mm

C: Medium-carbon aluminum killed steel sheet

Chemical composition (% by weight): C: 0.12–0.15, Si≦0.10, Mn: 0.50–1.00, P≦0.030, S≦0.030, Al: 0.02–0.06 and N≦0.005.

Sheet thickness: 2.4–2.9 mm (2) Conveying velocity of coated steel sheet: 50–140 m/min.

(3) Amount of deposition of coating: 15–35 am (on one side)

(4) Conditions for forced cooling with a cooling unit over the aluminizing bath

Coolant: air

Injection pressure: 80–430 mmAq

Injection rate: 400–2400 $m^3$/min.

(B) Evaluation of the alloy layers

Thicknesses and section patterns of the alloy layers produced on the respective test coated steel sheets were measured and evaluated with a scanning electron microscope (2000× magnification) by the method illustrated in FIG. 2 and FIG. 3.

(C) Evaluation of the press molding

The peeling resistance of the coating layers of the respective test specimens was evaluated by cupping draw-type press molding (hydraulically operated type) having the following specifications:

Punch diameter: 85 mm, blank diameter: 177 mm, draw depth: 40 mm, radii of the die shoulder and the punch shoulder: 4 mm.

Evaluation of the peeling resistance: sa: no peeling, a: minute peeling, b: medium peeling, c: severe peeling.

Table 3 lists the conditions for manufacture of the respective test specimens and results of the manufacture (scores for the alloy layers and evaluation of the press workability). The thicknesses of the produced alloy layers decrease, and the section patterns thereof become flatter as the first elapsed times and the second elapsed times are shortened, respectively. All the alloy layers of the coated steel sheets listed as the examples were found to have thicknesses of approximately 5 μm or less, maximum differential unevenness of thickness of approximately 5 μm and scores for the section patterns of 3 or more. In particularly, those test specimens which had definitely shorter second elapsed times had section patterns with excellent evenness in addition to the effect of controlling the alloy-layer thicknesses. Due to the effect of controlling the thicknesses and the section patterns of the alloy layers, the coated steel sheets had high peeling resistance which helped the plates satisfactorily endure severe working of cupping drawing. Notably, no peeling of the plating layers of the test specimens (A. 25, B. 22 and C. 22) with particularly excellent section evenness was observed during press working. In addition, all the coating layers were smooth and attractive, and had good surface quality (when evaluated through visual observation).

In contrast, the coated steel sheets listed as comparative examples, having had alloy layers which were thick and the sections of which were greatly uneven, had poor press workability. In particular, test specimen A. 14, though having been adjusted to have a short first elapsed time, had a thick alloy layer, since the aluminizing bath temperature was too high (melting point plus ca. 83° C.).

Although the first elapsed times were limited to approximately 20 seconds or shorter and the second elapsed times to approximately 16 seconds or less in the listed examples of the invention, the first elapsed times and the second elapsed times may be appropriately set depending on the use of the coated steel sheet products and the level of the peeling resistance required for press working, so as to produce the desired effect of controlling the thicknesses of the alloy layers.

TABLE 3

| NO. | Base-metal steel sheet material | Coating-bath composition (%) Si | Fe | Al | Coating-bath temp. (° C.) | 1st elapsed temp (sec.) | 2nd elapsed time (sec.) | Coating-layer thickness (μm) | Average alloy-layer thickness (μm) | Maximum differential unevenness of thickness of alloy-layer (μm) | Alloy-layer section pattern (score) | Press workability (evaluation) | |
|---|---|---|---|---|---|---|---|---|---|---|---|---|---|
| A.11 | A | 8.7 | ≦5 | Balance | 657 | 43.9 | 40.0 | 22.6 | 6.6 | 7.0 | 1 | c | Comp. |
| A.12 | A | 9.5 | ≦5 | Balance | 660 | 56.0 | 52.0 | 21.0 | 8.0 | 8.0 | 1 | c | example |
| A.13 | A | 8.5 | ≦5 | Balance | 660 | 37.1 | 32.9 | 18.6 | 6.3 | 6.5 | 2 | b | |
| A.14 | A | 8.9 | ≦5 | Balance | 695 | 16.3 | 12.2 | 19.3 | 6.0 | 4.0 | 3 | b | |
| A.21 | A | 9.3 | ≦5 | Balance | 638 | 11.5 | 11.2 | 18.2 | 3.6 | 4.0 | 3 | a | Example |
| A.22 | A | 8.2 | ≦5 | Balance | 661 | 20.3 | 15.6 | 16.1 | 5.1 | 4.3 | 3 | a | |
| A.23 | A | 8.0 | ≦5 | Balance | 657 | 16.0 | 13.5 | 21.3 | 4.4 | 4.0 | 3 | a | |
| A.24 | A | 9.2 | ≦5 | Balance | 663 | 14.3 | 10.3 | 18.0 | 4.0 | 3.5 | 4 | a | |
| A.25 | A | 9.0 | ≦5 | Balance | 665 | 5.7 | 3.8 | 17.4 | 2.6 | 2.1 | 5 | sa | |
| B.11 | B | 8.8 | ≦5 | Balance | 660 | 45.0 | 41.1 | 20.1 | 6.4 | 7.0 | 2 | b | Comp. |
| B.12 | B | 8.7 | ≦5 | Balance | 662 | 27.5 | 23.4 | 17.3 | 5.4 | 5.5 | 2 | b | example |
| B.21 | B | 9.0 | ≦5 | Balance | 657 | 16.0 | 11.8 | 32.2 | 4.5 | 3.7 | 3 | a | Example |
| B.22 | B | 9.1 | ≦5 | Balance | 659 | 6.6 | 4.4 | 18.3 | 3.0 | 2.5 | 4 | sa | |
| C.11 | C | 8.8 | ≦5 | Balance | 661 | 44.0 | 40.5 | 21.0 | 6.0 | 7.0 | 2 | b | Comp. example |
| C.21 | C | 8.4 | ≦5 | Balance | 662 | 16.3 | 12.0 | 20.3 | 1.6 | 3.9 | 3 | a | Exmaple |
| C.22 | C | 9.0 | ≦5 | Balance | 658 | 8.9 | 6.7 | 16.4 | 2.9 | 2.9 | 4 | sa | |

Industrial Applicability

As described above, since the hot-dip aluminized steel sheet according to the invention has both the alloy-layer thickness and the maximum differential unevenness of thickness of the alloy-layer controlled within the proper ranges, the peeling resistance of the coating layer is very high, and peeling of the coating layer is reliably prevented even when the sheet is subjected to strong working such as drawing or ironing.

In addition, since the alloy-layer thickness may be precisely controlled according to the invention, the alloy layer thickness may be set to a desired value depending on the degree of peeling resistance which is demanded by consumers for press working.

Also, the present invention allows effective control of the thickness of the produced alloy layer and control of the section pattern of the alloy layer to a flatter pattern. Further, there is no need to consider the sheet thickness, etc. for control of the alloy layer. In addition, unlike the prior art, without needing to adjust the sheet temperature during immersion of the coated steel sheet into the coating bath or to take troublesome measures such as surface treatment of the sheet with a metal layer, the alloy layer may be controlled much more precisely than in the prior art.

Also, since the alloy-layer control apparatus according to the invention allows precise control of the alloy-layer thickness and the value corresponding to the section pattern of the alloy layer to the desired values, the quality (peeling resistance) of the hot-dip aluminized steel sheet may be improved. This results in a greater degree of reliability during severe press working such as drawing or ironing.

Also, according to the invention, since the solidification location-detecting means detects the temperature distribution of the plated steel sheet in a two-dimensional manner, the full solidification-location is reliably determined even when it moves along the sheet width or in the direction of its conveyance. This results in accurate detection of the solidification completion location of the coating layer.

We claim:

1. A hot-dip aluminized steel sheet comprising:

a base-metal steel sheet having a surface;

an Al—Si coating-metal layer, provided on said surface of said base-metal steel sheet, having a Si content of 3–13% by weight;

an Fe—Al—Si alloy layer, formed between said base-metal steel sheet and said Al—Si coating-metal layer;

an interface between said Fe—Al—Si alloy layer and said Al—Si coating-metal layer; and wherein said Fe—Al—Si alloy layer has an average thickness of 1–5 μm and an average value of maximum differential unevenness of thickness, defined as a distance, measured perpendicularly from said surface of said base-metal steel sheet, between a point on said interface nearest said base-metal steel sheet and a point oil said interface farthest from said base-metal steel sheet, of 0.5–5 μm.

2. A method of manufacturing a continuous, hot-dip aluminized steel sheet, said method comprising:

guiding a base-metal steel sheet into a hot-dip aluminizing bath having an Al—Si bath composition with a Si content of 3–13% by weight, thus forming a coating-metal layer on said base-metal steel sheet, and forming an Fe—Al—Si alloy layer at an interface between said coating-metal layer and said base-metal steel sheet;

solidifying said coating-metal layer by cooling with aid from a cooling unit;

controlling a lapse of time from immersion of said base-metal steel sheet into said hot-dip aluminizing bath to completion of solidification of said coating metal layer, to limit a thickness of said Fe—Al—Si alloy layer to a desired level, based on a correlation between said lapse of time and said thickness of said Fe—Al—Si alloy layer; and detecting a temperature distribution of said coating-metal layer by a two-dimensional infrared camera.

3. The method according to claim 2, wherein said controlling a lapse of time includes adjusting at least one of a conveying velocity of said base-metal steel sheet and a flow rate of coolant of said cooling unit.

4. The method according to claim 3, wherein said controlling a lapse of time comprises:

calculating said lapse of time based on said conveying velocity of said base-metal steel sheet; and increasing at least one of said conveying velocity of said base-metal steel sheet and said flow rate of coolant of said cooling unit as said lapse of time increases; and wherein said detecting a temperature distribution of said coating metal layer includes detecting, at a downstream side of said cooling unit, to determine a final location, in a longitudinal direction of said coating-metal layer, at which solidification has been completed.

5. The method according to claim 9, wherein said controlling a lapse of time comprises:

calculating said lapse of time based on said conveying velocity of said base-metal steel sheet; and increasing at least one of said conveying velocity of said base-metal steel sheet and said flow rate of coolant of said cooling unit as said lapse of time increases; and wherein said detecting a temperature distribution of said coating metal layer includes detecting, at a downstream side of said cooling unit, to determine a final location, in a longitudinal direction of said coating-metal layer, at which solidification has been completed.

6. A apparatus, intended to be used with a system which guides a base-metal steel sheet into a hot-dip aluminizing bath to form an Al—Si coating-metal layer on the base-metal steel sheet and an Fe—Al—Si alloy layer therebetween and includes a cooling unit which aids in solidifying the coating-metal layer, for controlling the formation of the alloy layer, said apparatus comprising:

solidification location-detecting means for detecting a location where solidification of the coating-metal layer becomes complete;

velocity-detecting means for detecting a conveying velocity of the base-metal steel sheet;

velocity control means for controlling the conveying velocity of the base-metal steel sheet;

flow rate-detecting means for detecting a flow rate of a coolant of the cooling unit;

flow rate-control means for controlling the flow rate of the coolant of the cooling unit;

setting means for inputting a desired thickness of the alloy layer, a desired average value of a maximum differential unevennesses of thickness of the alloy layer, a distance between a point of immersion of the base-metal steel sheet into the hot-dip aluminizing bath and a point of departure of the base-metal steel sheet from the hot-dip aluminizing bath, and a distance between the point of departure from the hot-dip aluminizing bath and an outlet of the cooling unit;

operating means for calculating a first elapsed time from immersion of the base-metal steel sheet into the hot-dip aluminizing bath to the completion of solidification of the coating-metal layer, and a second elapsed time from departure of the base-metal steel sheet from the hot-dip aluminizing bath to completion of solidification of the coating-metal layer, the first and second elapsed times being calculated on the basis of the location where solidification of the coating-metal layer becomes complete, the conveying velocity of the base-metal steel sheet, the distance between a point of immersion of the base-metal steel sheet into the hot-dip aluminizing bath and a point of departure of the base-metal steel sheet from the hot-dip aluminizing bath, and the distance between the point of departure from the hot-dip aluminizing bath and the outlet of the cooling unit;

control means for calculating, in response to the first elapsed time and the second elapsed time determined by said operating means, a thickness of the alloy layer, which is determined by the first elapsed time and a correlation between the first elapsed time and the thickness of the alloy layer, and an average value of a maximum differential unevennesses of thickness of the alloy layer, which is determined by the second elapsed time and a correlation between the second elapsed time and the average value of a maximum differential unevennesses of thickness of the alloy layer, and for controlling at least one of said flow rate control means and said velocity control means so that the thickness of the alloy layer and the average value of a maximum differential unevennesses of thickness of the alloy layer match the desired thickness of the alloy layer and the desired average value of a maximum differential unevennesses of thickness of the alloy layer, respectively.

7. The apparatus of claim 6, where said solidification location-detecting means comprises:

a temperature distribution-detecting means for detecting a two-dimensional temperature distribution of the coating-metal layer;

an imaging means for imaging the two-dimensional temperature distribution;

an image display means for displaying an image of the two-dimensional temperature distribution and for detecting the location where solidification of the coating-metal layer becomes complete; and wherein the location where solidification of the coating-metal layer becomes complete is detected by referring to the displayed image.

8. The apparatus of claim 6, whereby the system is intended to produce a continuous hot-dip aluminized steel sheet, and the hot-dip aluminizing bath is intended to have an Al—Si bath composition with a Si content of 3–13% by weight.

* * * * *